US007832666B2

(12) United States Patent
Montgomery et al.

(10) Patent No.: US 7,832,666 B2
(45) Date of Patent: Nov. 16, 2010

(54) ARTICLE-DESTRUCTION APPARATUS AND METHOD OF ARTICLE DESTRUCTION

(75) Inventors: Larry Montgomery, Butternut, WI (US); Duane S. Chudy, Lincolnshire, IL (US)

(73) Assignee: Chudy Group, LLC, Powers Lake, WI (US)

( * ) Notice: Subject to any disclaimer, the term of this patent is extended or adjusted under 35 U.S.C. 154(b) by 438 days.

(21) Appl. No.: 11/740,631

(22) Filed: Apr. 26, 2007

(65) Prior Publication Data

US 2008/0283640 A1 Nov. 20, 2008

(51) Int. Cl.
*B02C 19/00* (2006.01)

(52) U.S. Cl. ..... 241/27; 241/73; 241/99; 241/100; 241/189.1; 241/606

(58) Field of Classification Search ..... 241/27, 241/73, 189.1, 100, 99, 30, 606
See application file for complete search history.

(56) References Cited

U.S. PATENT DOCUMENTS

| | | | | | |
|---|---|---|---|---|---|
| 3,229,921 | A | | 1/1966 | Hess et al. | |
| 3,703,970 | A | * | 11/1972 | Benson | 241/241 |
| 3,938,745 | A | | 2/1976 | Gladwin | |
| 4,062,500 | A | | 12/1977 | Peterson, Jr. | |
| 4,143,823 | A | * | 3/1979 | Judson, Jr. | 241/73 |
| 4,205,794 | A | * | 6/1980 | Horton et al. | 241/73 |
| 4,285,426 | A | | 8/1981 | Cahill | |
| 4,600,158 | A | | 7/1986 | Matoba | |
| 4,651,934 | A | * | 3/1987 | Bender et al. | 241/36 |
| 4,669,673 | A | | 6/1987 | Lodovico et al. | |
| 4,678,126 | A | | 7/1987 | Prentice et al. | |
| 4,809,915 | A | | 3/1989 | Koffsky et al. | |
| 4,871,118 | A | | 10/1989 | Maloney | |
| 4,889,290 | A | * | 12/1989 | Koffsky et al. | 241/36 |
| 4,923,126 | A | * | 5/1990 | Lodovico et al. | 241/30 |
| 4,932,595 | A | | 6/1990 | Cohen et al. | |
| 5,102,057 | A | | 4/1992 | Ellis, III | |
| 5,150,843 | A | | 9/1992 | Miller et al. | |
| 5,257,741 | A | | 11/1993 | Rode et al. | |
| 5,328,106 | A | * | 7/1994 | Griffin, Jr. | 241/99 |
| D358,399 | S | | 5/1995 | Tiedeman et al. | |
| 5,829,690 | A | | 11/1998 | Deschamps | |
| 6,520,435 | B1 | | 2/2003 | Robinson | |

(Continued)

OTHER PUBLICATIONS

Whitaker Datastroyer Rx Paper Shredder, Whitaker Brothers, Inc., Rockville, Marland. <www.whitakerbrothers.com> Date: Nov. 14, 2006.

(Continued)

*Primary Examiner*—Mark Rosenbaum
(74) *Attorney, Agent, or Firm*—Jansson Shupe & Munger Ltd.

(57) ABSTRACT

Apparatus for destruction of articles and any information associated therewith. Embodiments include an article-destruction chamber and a rotating head for repeated striking of articles and article fragments in the chamber. The head includes a body portion and a shaft. The body portion has plural striking elements extending radially outward therefrom. Each striking element has a forward-facing radial striking surface with an area. High-speed rotation of the head causes the striking surfaces to violently contact and destroy articles and article fragments in the chamber and to render any associated information unusable.

31 Claims, 16 Drawing Sheets

U.S. PATENT DOCUMENTS

| | | | |
|---|---|---|---|
| 6,877,685 | B2 | 4/2005 | Barth et al. |
| 6,957,784 | B1 | 10/2005 | Barkan et al. |

OTHER PUBLICATIONS

"Whitaker Brothers Data Destruction and Equipment & Supplies Catalog 2007/2008," Whitaker Brothers, Inc., Rockville, Marland. <www.whitakerbrothers.com> Date: 2007.

"Whitaker Brothers Datastroyer 1000 Data Disintegrator." Whitaker Brothers, Inc., Rockville, Maryland. <www.whitakerbrothers.com> Date: Undated.

"Whitaker Brothers X-1 Fan-Type Waste Evac System." Whitaker Brothers, Inc., Rockville, Maryland. <www.whitakerbrothers.com> Date: Undated.

"Datastroyer 120 Data Disintegrator." Whitaker Brothers, Inc., Rockville, Maryland. <www.whitakerbrothers.com> Date: Undated.

"Datastroyer 210 w/FC-1." Whitaker Brothers, Inc., Rockville, Maryland. <www.whitakerbrothers.com> Date: Undated.

"Whitaker Brothers X-2 Fan-Type Waste Evac System." Whitaker Brothers, Inc., Rockville, Maryland. <www.whitakerbrothers.com> Date: Undated.

"Datastroyer 320 Data Disintegrator." Whitaker Brothers, Inc., Rockville, Maryland. <www.whitakerbrothers.com> Date: Undated.

"Datastroyer 440 Data Disintegrator." Whitaker Brothers, Inc., Rockville, Maryland. <www.whitakerbrothers.com> Date: Undated.

"Datastroyer 360B/MC Data Disintegrator." Whitaker Brothers, Inc., Rockville, Maryland. <www.whitakerbrothers.com> Date: Undated.

"Datastroyer 600 Data Disintegrator." Whitaker Brothers, Inc., Rockville, Maryland. <www.whitakerbrothers.com> Date: Undated.

"Datastroyer 800 Data Disintegrator." Whitaker Brothers, Inc., Rockville, Maryland. <www.whitakerbrothers.com> Date: Undated.

Bottle and Medication-Container Grinder. Four Photographs. Date: Mar. 24, 2006.

* cited by examiner

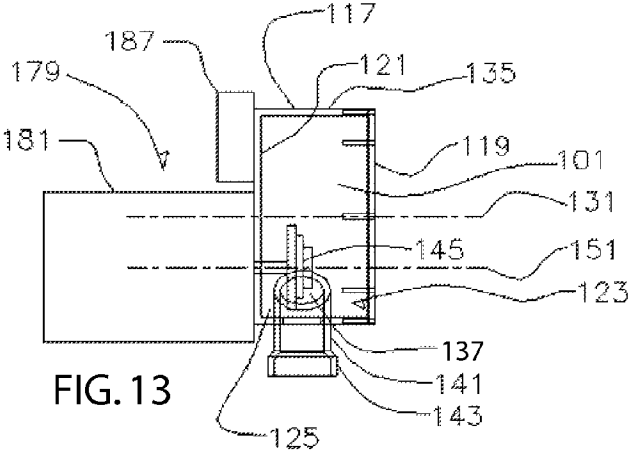
FIG. 13
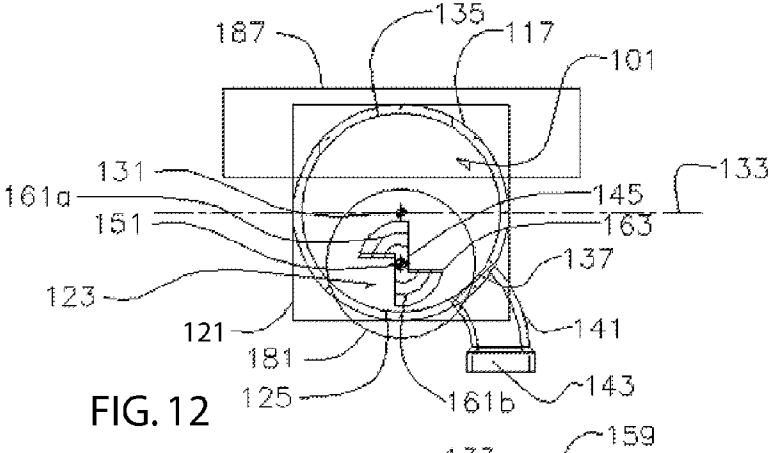
FIG. 12
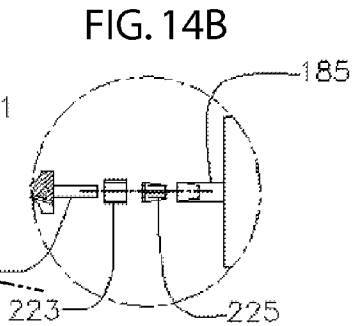
FIG. 14B
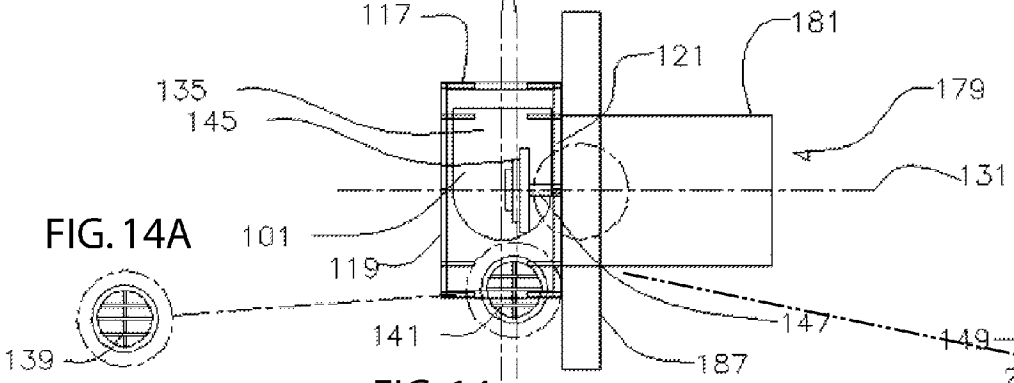
FIG. 14
FIG. 14A shear angle
167
163
145b
169
161a
147
161b
149
151
161B
175
177
155
153
157

ARTICLE-DESTRUCTION APPARATUS AND METHOD OF ARTICLE DESTRUCTION

FIELD

The field relates generally to solid material comminution or disintegration and, more particularly, to destruction of articles and associated information.

BACKGROUND

Pharmacies, healthcare providers, vendors, and others are frequently required to dispose of waste articles, including containers for consumable products such as medications, vitamins, supplements, and the like. Many different container types are used to package these types of consumable products. Examples include vials, bottles, clam shells, tubes, boxes, blister packages, and other container types. These containers are typically made of, or include, plastic and have material properties ranging from stiff and rigid to pliant.

Many of these container types can include highly confidential or sensitive information. For example, medication containers used to fulfill patient prescription orders typically include important information relating to the patient. Such information typically includes patient name information, medication type information and prescriber information. The patient information provided on the medication container may reveal aspects of the patient's health status that the patient would not want others to know. The patient information is commonly printed in human-readable form on an adhesive-backed label affixed to the outside of the container or on the container itself. The patient information may also be associated with the container in machine-readable form, such as by means of a bar code or radio frequency identification tag (RFID).

Laws such as The Health Insurance Portability and Accountability Act (HIPAA) require that medical records, medical billing, and patient accounts meet certain consistent standards with regard to privacy. One important aspect of HIPAA compliance relates to protection of patient privacy when it becomes necessary to dispose of containers and other articles including confidential patient information.

By way of example, a pharmacy requested to refill a patient prescription order will often be required to dispose of an empty medication container presented by the patient to the pharmacist to initiate the refill request. HIPPA compliance requires that the pharmacy completely destroy any confidential patient information associated with the empty container so that the information is rendered unuseable by others. A waste disposal solution, other than merely placing the intact empty container in a waste receptacle, is required to comply with privacy regulations.

It may also be desirable for pharmacies, healthcare providers, vendors, and others to seek creative waste disposal solutions for container-type articles in order to better comply with environmental regulations and minimize waste-disposal costs. As can be appreciated, one problem with disposal of articles such as medication containers is the volumetric bulk of the articles. Conventional disposal of these types of articles involves placing the articles in a waste receptacle to await removal by a waste-removal service. However, the bulk of these types of articles is such that the waste receptacle may be quickly filled to the exclusion of other waste material. As a consequence, additional storage space may be required to store the waste receptacles and additional costs may be imposed for waste removal due to the increased volume of waste produced. Disposal of bulky articles is not environmentally friendly because of the large volumetric landfill space required.

Various article-destruction devices have been proposed, but such devices have certain disadvantages. For example, U.S. Pat. No. 4,932,595 (Cohen et al.) is directed to a plastic article shredding device which requires the combined operation of a complex auger-type feed assembly and a granulator. The auger first shreds the article. Next, in the granulator, fixed and rotating knives coact to further cut and reduce the size of the shredded plastic articles. This arrangement, however, does not optimally reduce the size of the articles and does not appear to have the capability of completely destroying information which may be associated with the plastic articles. The required machine structure also adds cost to the device.

U.S. Pat. No. 6,520,435 (Robinson) is directed to a plastic article processing device which utilizes whips to shred plastic containers into small strips. Use of whip-type shredding devices does not necessarily ensure complete destruction of an article, such as a pliant-type medication container, together with confidential patient information associated with the container.

U.S. Pat. No. 6,957,784 (Barkan et al.) describes a glass bottle crushing system which employs a horizontally-oriented rotating bar to break glass articles falling from a chute past the bar. While perhaps suitable for destroying brittle glass articles, the rotating bar would not necessarily be effective at destroying lightweight plastic medication containers so that any information associated therewith is fully and consistently rendered unusable.

The Whitaker Datastoyer Rx Paper Shredder available from Whitaker Brothers, Inc. of Rockville, Md. is said to employ a cross-cut-type shredder to destroy prescription bottles, pharmacy labels, prescription pads and patient files. Cross-cut-type shredders require complex intermeshing cutters and other mechanical components which are unduly complex and add cost to the price of the device. And, such cross-cut-type cutters may not be suitable for destroying a full range of three-dimensional articles, including medication containers.

There is a need for an article-destruction apparatus which would be capable of effective and reliable destruction of articles, such as medication containers which are rigid or which are pliant, which would completely and reliably destroy and render unusable any information associated with the articles and containers, which would reduce waste volume, which would have a simple design, and which would be compact and easy to use.

SUMMARY

Apparatus and methods for destruction of articles and any associated information. The apparatus and methods may be used, for example, to destroy medication containers and any patient-related information which may be associated with the containers such as by means of a label or other information-containing element. The apparatus and methods facilitate compliance with rules regarding destruction of confidential information, while at the same time reducing waste volume. Apparatus of the type described herein may be used by a pharmacy, health-care provider, vendor or another faced with article disposal. The apparatus and methods are discussed in the context of disposal of medication containers but may be used to destroy other types of articles.

In preferred embodiments, the apparatus comprises an article-destruction chamber having an article inlet, a trough including a trough bottom, and an article-fragment outlet. A head is provided to strike articles and article fragments within the chamber. The head repeatedly strikes the article fragments until they are reduced to a small size and any associated information is rendered unusable.

Preferably, the head includes a coaxial body portion and shaft. The preferred body has an axis of rotation, a radial extent about the axis, and an axial extent. A preferred body further includes plural striking elements which extend radially outward from the body. Each of the preferred striking elements has a peripheral edge and a forward-facing radial striking surface. Each forward-facing radial striking surface has an area extending along at least a portion of both the radial and axial extents. Each such surface may be planar, concave, convex or any other suitable shape having an area.

The head is positioned so that. during head rotation, the striking elements pass within the trough closely proximate the trough bottom to strike articles and article fragments in the trough and chamber. Repeated contact between the fragments and head reduces the articles and fragments to a small size, thereby destroying the articles and any associated information.

A drive apparatus is provided, preferably to power high-speed rotation of the head for destruction of articles and article fragments in the chamber. An electric motor in direct drive relationship with the shaft is most highly preferred. The preferred high speed refers to rotation of the head at rates exceeding 7,000 revolutions per minute (RPMs). It is most highly preferred that the drive apparatus rotate the head at between 10,000 to 25,000 RPMs. A control apparatus operatively controls the drive apparatus.

The chamber, head, drive, and control apparatus are most preferably located in a housing. Articles to be destroyed may be delivered to the chamber by means of a hopper or other structure, such as a chute. Preferably, structure is provided which prevents fragments from exiting the chamber article-fragment outlet until the fragments have been reduced to a desired small size. Articles and fragments exceeding the desired size are circulated within the chamber for continued striking until they are sufficiently small to exit the chamber.

Preferably, an article-fragment receptacle is provided in the housing for receiving article fragments from the chamber. Preferred types of receptacles are bags, boxes, bins and totes. A control may be provided as part of the control apparatus to de-power the drive apparatus once the receptacle is full or partially full to a desired extent.

Various other optional features, such as an article-fragment filtration system, may be implemented to remove small airborne article fragments or particles from the housing. The filtration system may optionally include a hepafilter or other filter medium. Still other optional features, such as interlock controls associated with access panels and apparatus doors, may be used by the control apparatus to deactivate the drive apparatus if such panels or doors are open.

Methods of article destruction utilizing the apparatus are discussed herein.

BRIEF DESCRIPTION OF THE DRAWINGS

Exemplary article-destruction apparatus may be understood by reference to the following description taken in conjunction with the accompanying drawings, in which like reference numerals identify like elements throughout the different views. For convenience and brevity, like reference numbers are used for like parts amongst the alternative embodiments. The drawings are not necessarily to scale, emphasis instead being placed upon illustrating the principles of the invention. In the accompanying drawings:

FIG. 12 is a schematic front elevation view of an exemplary article-destruction chamber taken along section 12-12 of FIG. 11;

FIGS. 13-14 are schematic side and top views of the exemplary article-destruction chamber of FIG. 12;

FIG. 14A is an enlarged fragmentary view of the circled portion of FIG. 14;

FIG. 14B is an enlarged fragmentary exploded view of the circled portion of FIG. 14;

Figure 1:
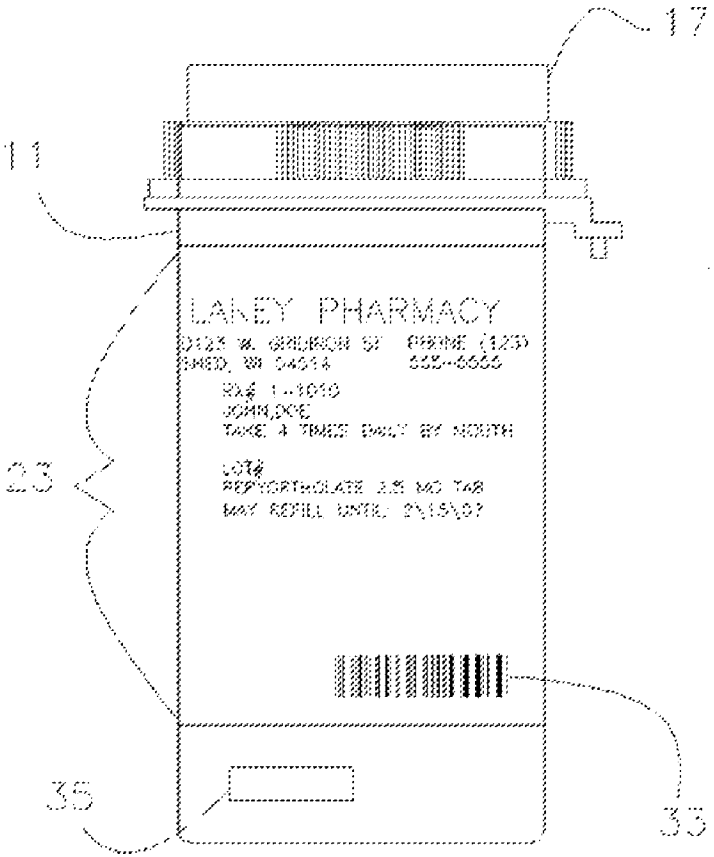
FIGS. 1-3 are representative medication containers each including confidential patient information associated therewith.

While the apparatus and methods are susceptible to various modifications and alternative forms, specific embodiments thereof have been shown by way of example in the drawings and are herein described in detail. It should be understood, however, that the description herein of specific embodiments and methods is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 22:
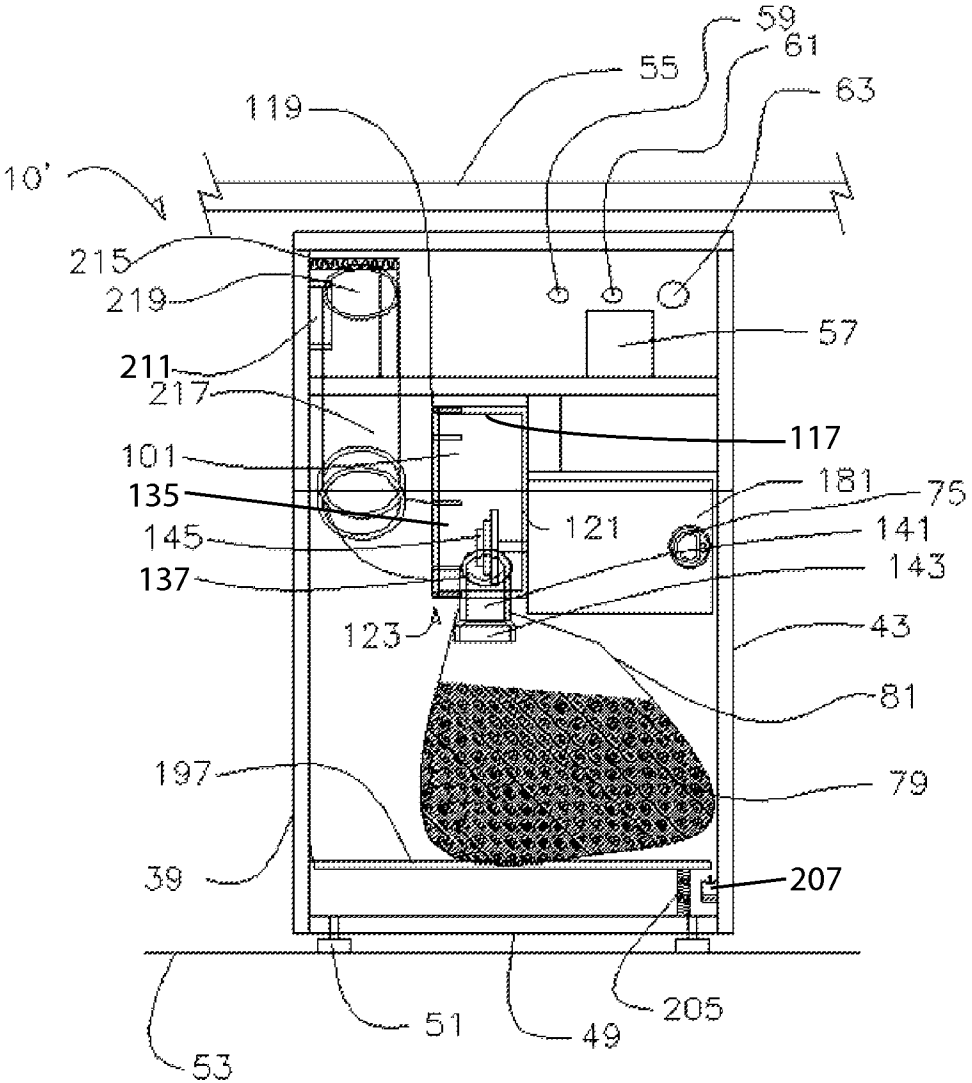
FIGS. 22-23 are schematic front and side elevation views of a further embodiment of an article-destruction apparatus with housing sides removed and showing internal apparatus components.
Figure 23:
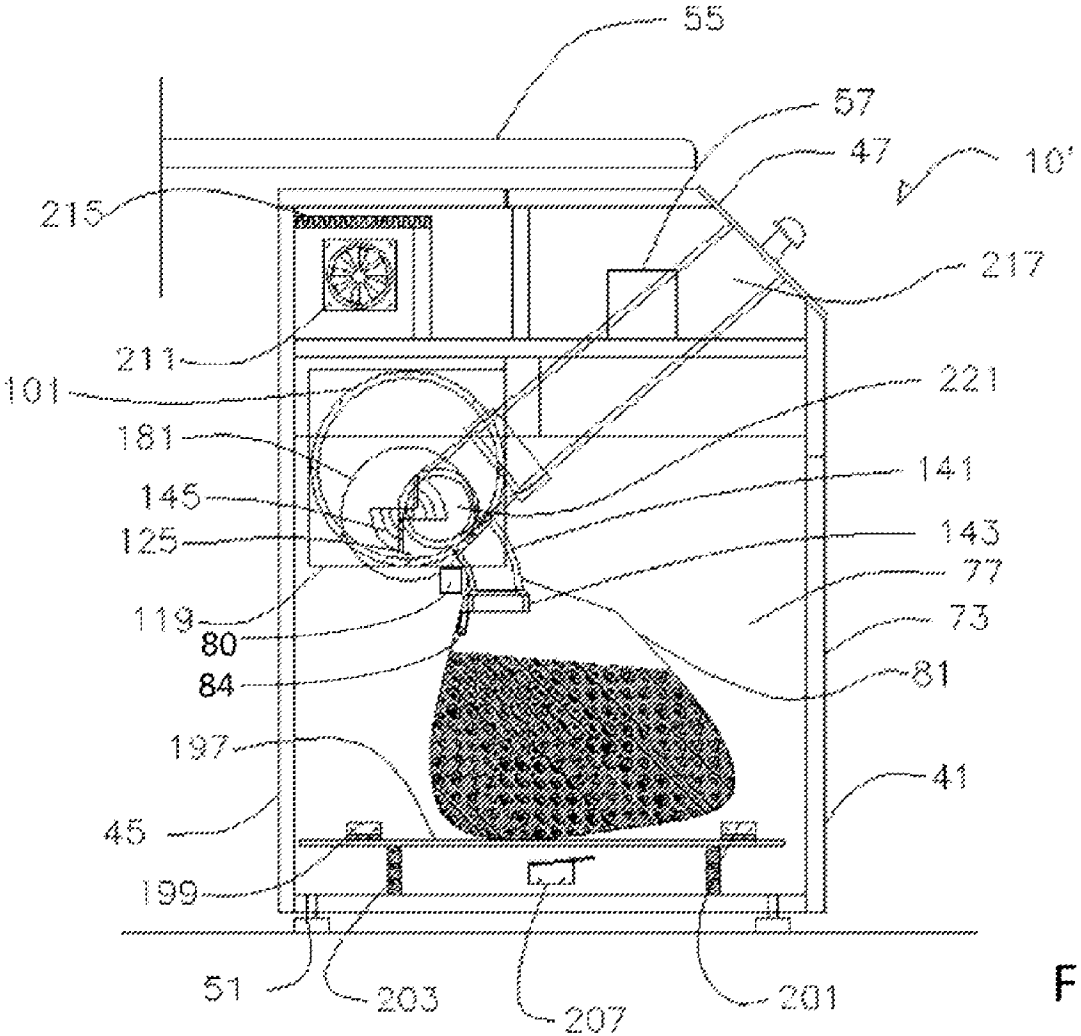

FIGS. 5-8 show one embodiment of an article-destruction apparatus 10. FIGS. 22-23 show a further article-destruction apparatus 10' embodiment. Article-destruction apparatus 10, 10' are useful in destroying a wide-range of articles, such as the consumable products containers 11, 13, 15 of FIGS. 1-3 and information 23 associated with such containers 11-15. Article-destruction apparatus 10, 10' are described in the context of use in health-care-related applications but may be used for article destruction in other settings. The term "article" as used herein is intended to have an expansive meaning and to include any particular object or thing capable of being destroyed by apparatus of the type described herein, including containers 11-15 and other articles. Solely for convenience and brevity, like reference numbers are used for corresponding parts of article-destruction apparatus embodiments 10, 10' and other alternative structure described herein.

Figure 2:
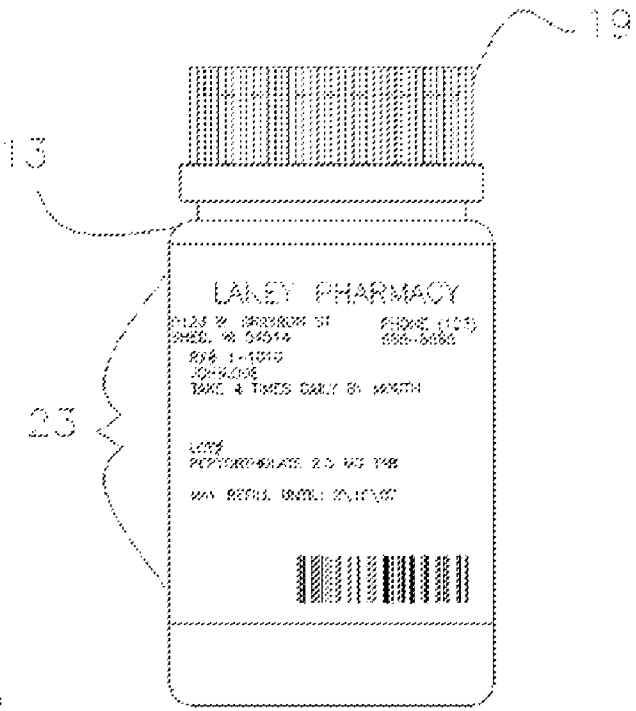
Figure 3:
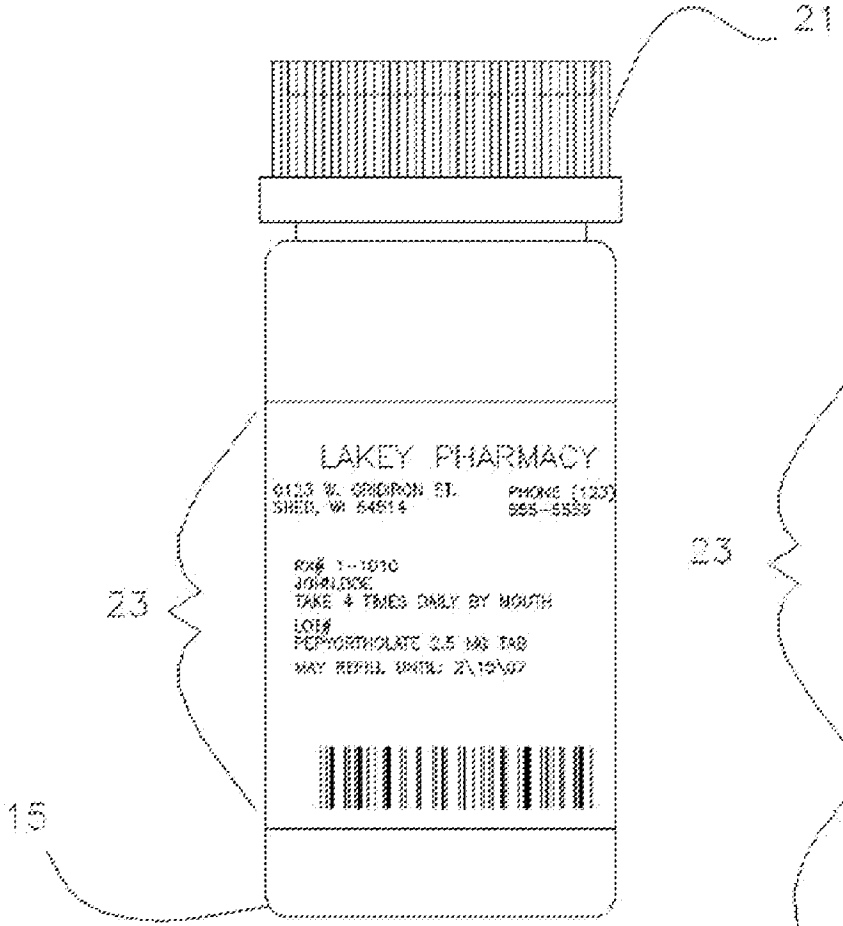
Figure 7:
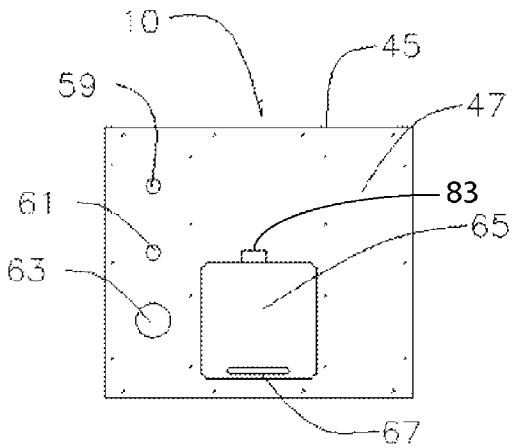
FIGS. 5-7 are schematic front side and top views of an article-destruction apparatus embodiment with certain parts in open or closed positions or not shown to facilitate understanding of the apparatus.

Referring then to FIGS. 1-3, containers 11-15 are illustrative of container types typically used by a pharmacy, healthcare provider, vendor, or another to hold consumable products such as medications, vitamins, supplements, and the like. Each container 11-15 includes a cap or closure 17, 19, 21 which is secured across a container opening (not shown) through which the consumable product is loaded into and taken out of container 11-15. Each closure 17-21 mates with corresponding threads or tabs (not shown) located proximate each container opening and is screwed or snapped onto and off of container 11-15 depending on the container structure. Containers (e.g., containers 11-15) may be structured to hold medications and other products of any form including solid, semi-solid and/or liquid forms. Solid and semi-solid medications may be in any suitable form including tablets, spheres, triangles, capsules, caplets, gel caps, powders, etc.

Containers 11-15 are commercially available in many forms and sizes as indicated by FIGS. 1-3. Containers, such as containers 11-15, are available in industry-standard sizes such as 60, 40 or 20 drams, but also are available in other sizes. Other containers, such as bulk-form medication supply containers, can have a much greater volume. As can be appreciated, these types of containers have a large volumetric bulk, thereby creating a waste-disposal problem for the pharmacy, healthcare provider, vendor, or other user.

Consumable products containers, such as containers 11-15, are typically made of, or include, plastic materials. Representative plastic materials are virgin and non-virgin polycarbonate, polyethylene terepthalate (PETE), high-density polyethylene (HDPE), polyvinyl chloride (PVC/vinyl), polypropylene (PP), and combinations of these materials. The containers are manufactured by any suitable method, including by injection molding, blow molding, and thermoforming.

While the use of plastic materials is commonplace with respect to containers and other articles capable of being destroyed by apparatus 10, other materials or material combinations may be used as well. Representative types of further materials which may be used for manufacture of containers 11-15 and other articles can include glass, paper/cellulosic materials and combinations of plastic, glass and paper/cellulosic materials (e.g., paperboard, cardboard). The resultant containers and articles, including containers 11-15, can have a range of material properties from rigid or pliant and shatter, shred, disintegrate or otherwise break apart into article fragments when contacted by a high-speed striking surface. By way of illustration only, plastic containers can have durometers of between about 60 to about 98 on the Shore A scale depending on the materials used.

Referring further to FIGS. 1-3 and 4, information 23 may be associated with the container 11-15 or other article. Some or all of such information 23 may be of a highly confidential nature. It is an objective of apparatus 10, 10' to completely destroy and render unusable such information 23. This information-destruction capability of apparatus 10, 10' enables a pharmacy, healthcare provider, vendor, or another to dispose of waste material in full compliance with HIPPA and other privacy-related regulations.

Figure 4:
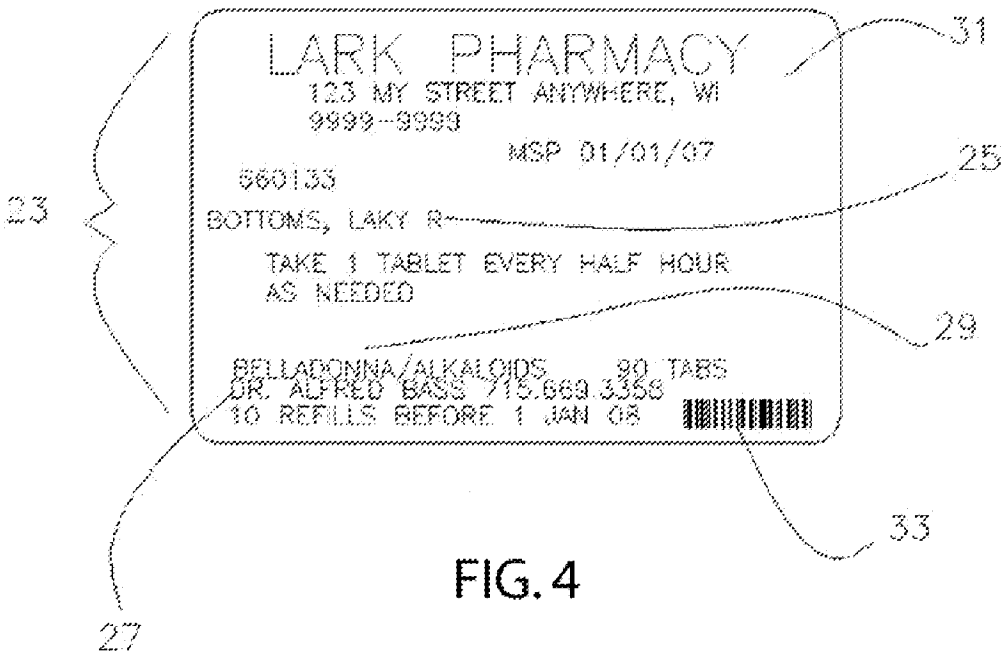
FIG. 4 is a representative medication container label including confidential patient information.

As shown in FIG. 4, many types of information 23 may be associated with a container 11-15 or article. Information 23 which typically would be provided on a container used for fulfillment of a patient prescription order includes: the patient's name 25, the prescriber's name 27, the medication type and quantity 29 and other information relevant to the prescription order, such as medication lot number, expiration date, instructions, sigs. (i.e., standardized warnings and notices), refill information and telephone numbers.

Information 23 may be associated with container 11-15 in any suitable manner. For example, information 23 may be associated with a patient-specific adhesive-backed label 31 affixed to an outer surface of container 11-15 as shown in FIGS. 1-4. Such a label 31 may be generated with information 23 thereon and then applied to the container 11-15 by pharmacy personnel or by an automated labeling machine. And, information 23 may be associated with container 11-15 in other ways, such as by a machine-readable bar code 33 on the label 31, or directly on the container 11-15. Information 23 may also be embedded in a machine-readable RFID tag 35 (FIG. 1) secured to or within container 11-15. As technology evolves and advances, it is anticipated that information 23 of other types and forms may be utilized. Some or all of this information 23 may be confidential and must be protected from public disclosure if the pharmacy, healthcare provider, vendor, or other user is to comply with HIPAA or other privacy-related regulations.

Figure 5:
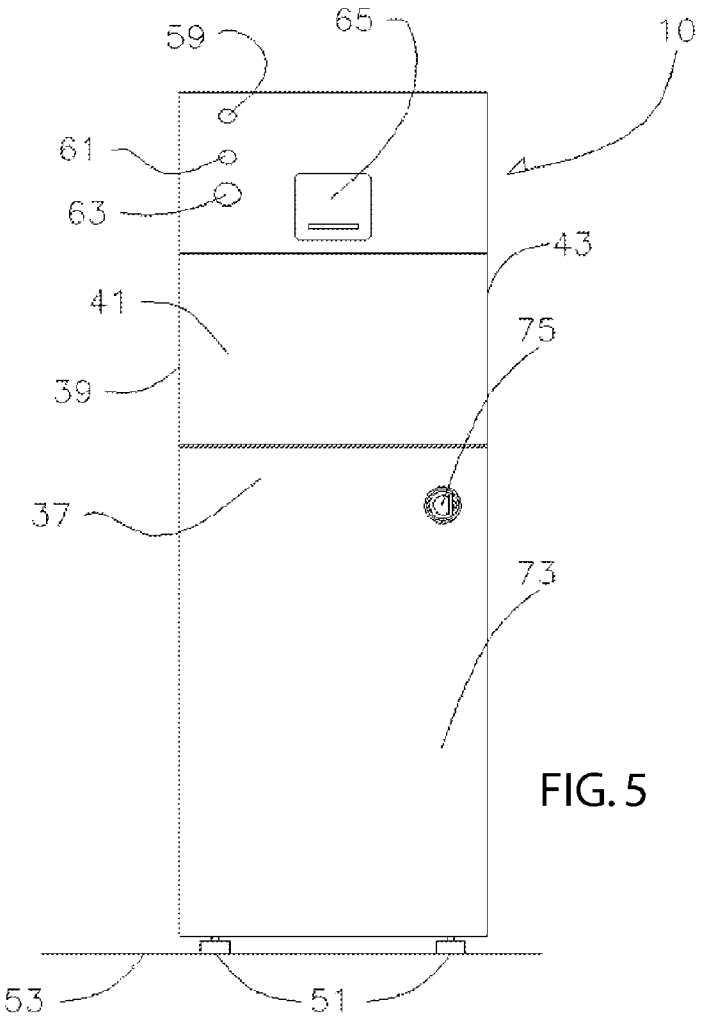

Referring now to FIGS. 5-11 and article-destruction apparatus 10 shown therein, the apparatus 10 is preferably provided as a compact, self-contained unit within a housing 37 or other enclosure. In the examples, housing 37 includes side 39, 41, 43, 45, top 47 and bottom 49 walls. Legs, of which legs 51 are exemplary, support housing 37 on a surface, such as a floor 53 (FIG. 5). Other supports, such as wheels, may be provided in place of, or in combination with, legs. Each leg (e.g., leg 51) may be adjustable to permit leveling of article-destruction apparatus 10 if the floor 53 surface is not level.

Figure 9:
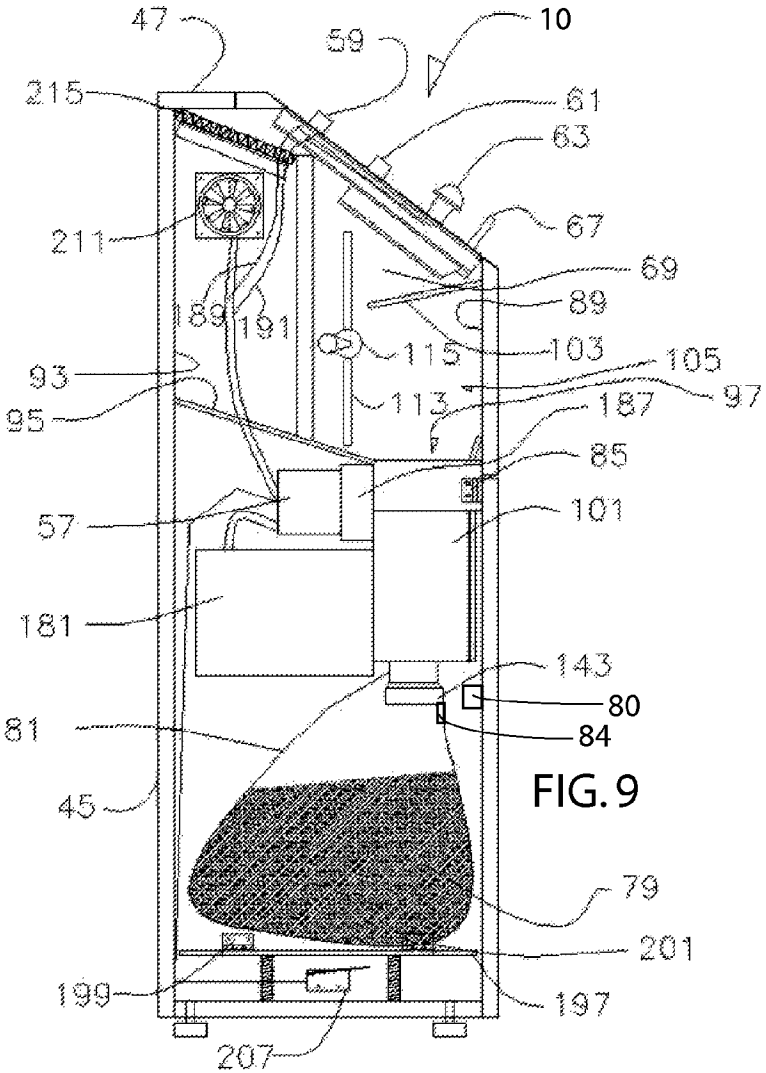
Figure 11:
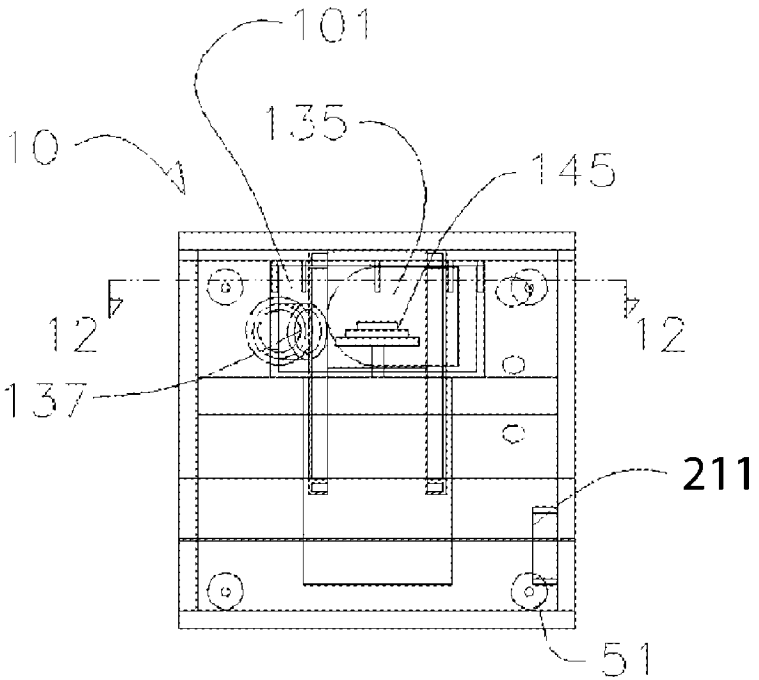

In the example, housing top side 47 may be angled to facilitate ease of user access to various controls provided to permit user interface with control apparatus 57 (FIG. 9). In the example, a push-button-type start control 59, an indicator lamp 61, and a push-button-type emergency stop control 63 are provided along top side 47. A motor run time control 64 (FIG. 24) may be provided within control apparatus 57 to permit the time period of motor operation to be set from amongst a plurality of time period settings. Operation of the appropriate control 59, 63, causes control apparatus 57 to control operation of apparatus 10, 10' as described elsewhere. Any suitable form of user interface may be provided enabling a user to interact with control apparatus 57. For example, a display device with a graphical user interface (GUI) may be provided along top side 47 in place of controls 59, 63.

Article-destruction apparatus 10 includes a door 65 with grasping handle 67 covering access to inlet 69 of article hopper 71 located within housing 37. Door 65 may be mounted by means of hinges, tracks, slides or other securement apparatus (not shown) to top side 47. Housing front side 41 includes an access panel 73 mounted to housing 37 by hinges (not shown) or other suitable means. A lockable latch mechanism 75 controls opening of access panel 73. Opening of panel 73 provides access to fragment-collection chamber 77 for collection and removal of article fragments, cleaning or service of apparatus 10. As shown in FIGS. 6-10, article fragments 79 may be collected in a receptacle 81 of which the bag-type receptacle shown is exemplary. Other types of receptacles 81 such as boxes, bins and totes may be used in place of bag-type receptacle 81.

To facilitate recycling of fragments 79, a separate receptacle 81 could be provided for each type of material to be destroyed, thereby avoiding co-mingling of article fragments 79 of different material types. For example, a separate bag-type receptacle 81 could be provided for PETE, HDPE, PVC, and PP plastic materials. Each such receptacle 81 may be marked with the recycling symbol or logo for the type of plastic contained therein. Thus, a receptacle 81 for PETE plastic material fragments 79 may include the recycling code number 1, a receptacle for HDPE plastic material fragments 79 would include the recycling code number 2 and so forth.

Optionally, a detector 80 operably connected to control apparatus 57, may be provided to indicate that a receptacle 81 is not present or to indicate that receptacle 81 is from an unauthorized source. Detector 80 is useful to avoid unwanted discharge of article fragments 79 into chamber 77 if a receptacle is not present. The detection system including detector 80 ensures operation of article-destruction apparatus 10 with receptacles 81 which are suited for use with apparatus 10.

Detector 80 includes contacts 82 (FIG. 24) which are closed upon detection of a detectable element 84 associated with receptacle 81. Closure of contacts 82 causes control apparatus 57 to deactivate indicator lamp 61. Opening of contacts 82 indicates that a receptacle 81 is not present or that an unauthorized receptacle 81 is present causing control apparatus 57 to activate lamp 61 to provide a signal to the user that the apparatus 10 should not be activated.

If provided, detector 80 is located in housing 37 proximate receptacle 81 and contacts 82 are part of control apparatus 57. Detector 80 is sufficiently proximate to receptacle 81 to detect element 84 associated with receptacle 81. Element 84 may, by way of example only, comprise a ferrous metal strip, ferrous-metal-containing ink, or radio frequency identification tag (RFID) associated with receptacle 81. If a bag-type receptacle 81 is provided, element 84 may be affixed to the receptacle 81 by adhesive, welding, or other suitable form of attachment. A ferrous-metal-containing ink element 84 may be affixed to receptacle 81 by printing. A suitable detector 80 for detecting a ferrous metal element 84 is a Model VM-A0-2H proximity sensor from Automation Direct of Atlanta, Ga.

Interlock devices 83, 85 operably connected to control apparatus 57 may be provided to deactivate article-destruction apparatus 10 when door 65 or panel 73 is/are open. Operation of interlocks 83, 85 provides a signal to control apparatus 57 to prevent operation of apparatus 10 to destroy articles (e.g., containers 11-15) when respective door 65 and/or panel 73 is/are opened.

Housing 37 sides 39-49, door 65 and access panel 73 may be made of any suitable rigid material capable of supporting housing 37 and its components. Formed sheet steel, aluminum or plastics are preferred. Melamine and other wood-based products may be used. Preferably, housing 37 is provided with generally continuous outer surfaces to limit access to the components located within housing 37.

Figure 8:
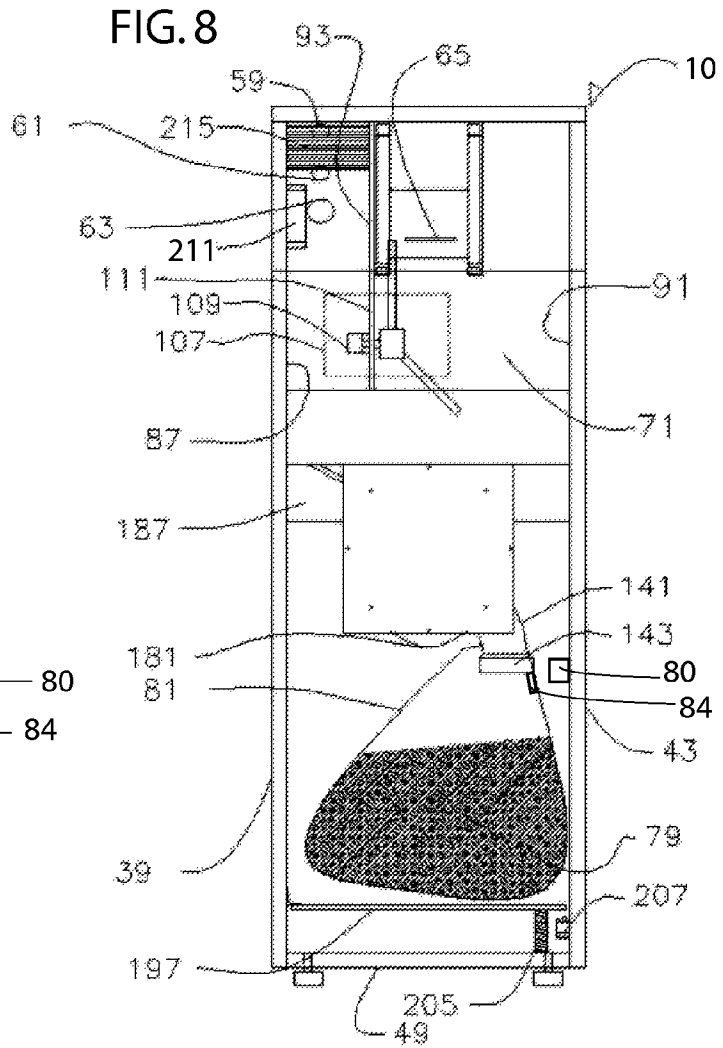
FIGS. 8-11 are schematic front, side, rear and top views of the article destruction apparatus of FIGS. 5-7 showing internal apparatus components.
Figure 6:
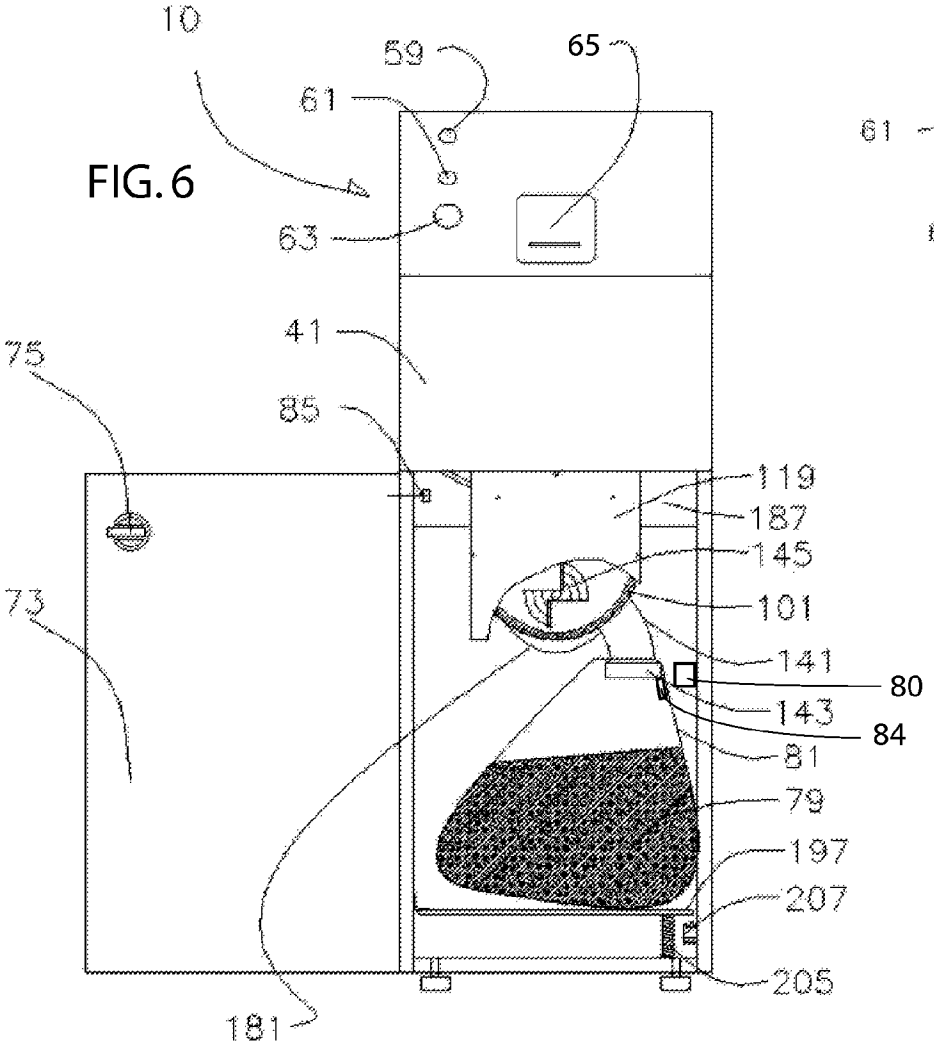
Figure 10:
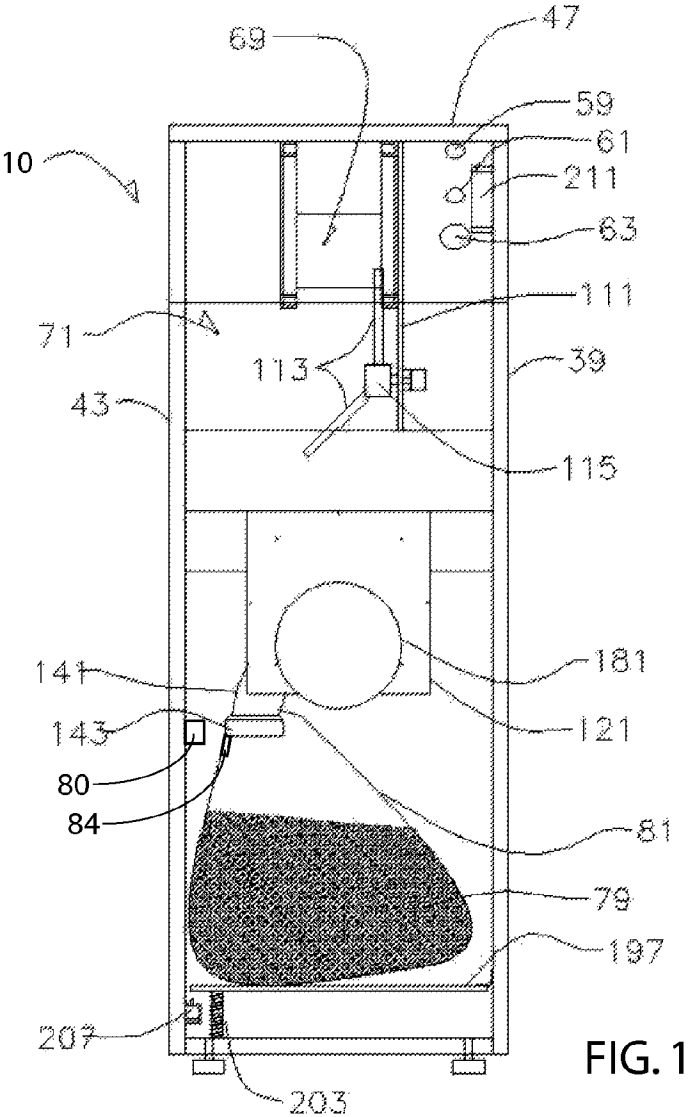

Referring now to FIGS. 8-10, hopper 71 is defined by walls 87, 89, 91, 93 and 95. Containers (e.g., 11-15) and articles to be destroyed are loaded into hopper inlet 69 (preferably through door 65) and move by means of gravity to exit hopper 71 through hopper outlet 97 which is in communication with inlet 135 of article-destruction chamber 101. Hopper wall 103 extends inwardly from wall 89 to cooperate with walls 87, 89, 91, and 93 to provide a serpentine path 105 preventing insertion of a user's hand and arm through hopper inlet 69 and into article-destruction chamber 101.

As shown in FIGS. 8-10, article-destruction apparatus 10, includes an optional agitator 107 within hopper 71 powered by direct-drive motor 109 to contact and displace containers (e.g., containers 11-15) and articles in hopper 71 to ensure free-flow of containers down and toward article-destruction chamber 101. Motor 109 attached to strut 111 includes a drive shaft which supports agitator rotary hub 115 which includes flexible arms, of which arm 113 is exemplary, extending radially outward from hub 115. Arms (e.g., arm 113) may, for example, be tension springs or whips. Motor 109 powers rotation of hub 115 and the attached arms 113 contact articles in hopper 71.

Figures 15, 16:
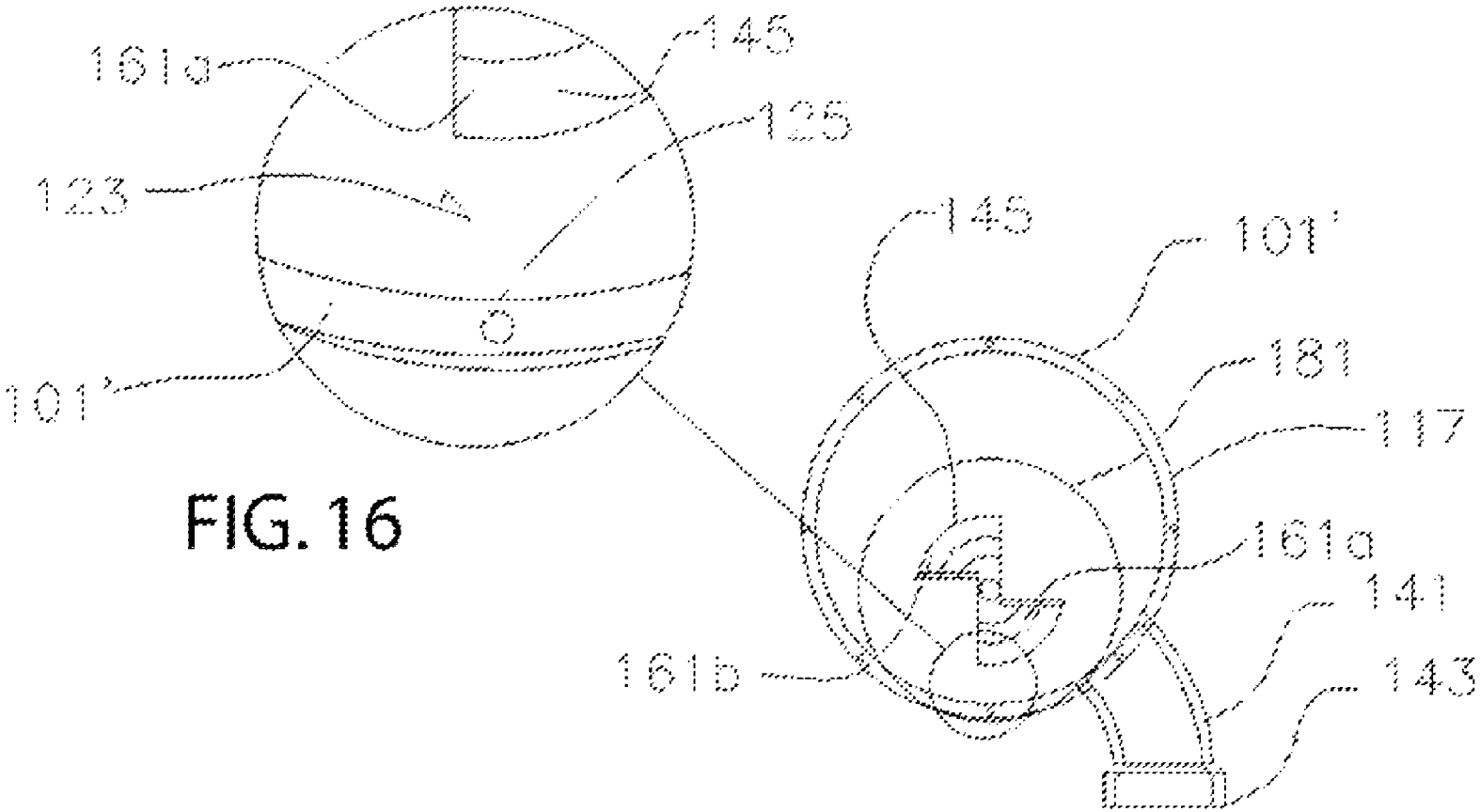
FIG. 15 is a schematic front elevation view of a further exemplary article-destruction chamber taken along a section, such as section 12-12 of FIG. 11.
FIG. 16 is an enlarged view of the circled portion of the article-destruction chamber of FIG. 15.

Referring next to FIGS. 6, 9, and 11-14, article-destruction chamber 101 is provided to destroy articles (e.g., containers 11-15) together with any information 23 which may be associated with such articles. A further article-destruction chamber 101' embodiment is illustrated in FIGS. 15-16. Chamber 101' is generally identical to chamber 101 but is provided to show an alternative location of head 145. After processing in article-destruction chamber 101, 101', any information 23 is rendered completely unusable, thereby protecting patient privacy. Articles processed in article-destruction chamber 101, 101' are reduced to small article fragments 79 which compact naturally to yield a decreased waste volume when compared to the volume of the articles and containers before destruction as represented by the article fragments 79 compacted in receptacle 81 shown in FIGS. 6 and 8-10.

In the examples, article-destruction chamber 101, 101' have a generally cylindrical geometry defined by a generally annular inner wall 117 and a pair of opposed end walls 119, 121. Walls 117, 119, 121 define a trough 123 along their lower ends into which articles (e.g., containers 11-15) and article fragments 79 fall and collect for the purpose described below. Trough 123 includes a trough bottom 125 along inner wall 117 in the example. In the embodiments, preferred generally-cylindrically-shaped chamber 101 has a chamber central axis 131 bisecting chamber 101 in one direction between end walls 119, 121 and a chamber lateral axis 133 bisecting chamber 101 laterally. Chamber 101' preferably includes similar axes. An access door (not shown) may be provided in wall 119 to permit operator access to chamber 101 to clear any jam condition which may exist.

In the exemplary article-destruction apparatus 10, chamber inlet 135 is provided to introduce articles from hopper outlet 97 into chamber 101. In the example, inlet 135 is along an upper portion of inner wall 117. Chamber outlet 137 is preferably provided in a lower surface of wall 117 proximate trough 123. Preferably, outlet 137 comprises plural openings 139 in chamber wall 117 of the type shown in FIG. 14A. Openings 139 are sized so that only those article fragments 79 of a reduced size less than that of the openings 139 can pass through to exit chamber 101. Article fragments 79 of a reduced size larger than that of openings 139 are circulated within chamber 101 for further size reduction. In other embodiments, outlet 137 could comprise a single relatively large opening with a removable barrier (not shown) thereacross. A removable barrier would have the advantage of being removable for cleaning, repair or for replacement with a further barrier member having openings of a different size. Such a barrier could comprise a mesh, sieve, screen or the like having plural openings sized to permit article fragments 79 smaller than the openings to pass therethrough. The barrier could be adjustable permitting the user to enlarge or reduce the openings thereby providing the user with the capability to control the size of the article fragments 79.

In the embodiments, a tubular nozzle 141 with a flanged end 143 extends outward from chamber 101, 101' and is provided to channel article fragments 79 from chamber 101, 101' to receptacle 81. Receptacle 81 may be secured to flange 143 by any suitable means, such as an elastic band or tie.

Considerable variation is possible with respect to the structure and geometry of chamber 101, 101'. For example, trough as used herein refers to a lower portion of chamber 101, 101' and trough 123 may be of any suitable shape facilitating collection of articles and article fragments 79 therein. Chamber inlet and outlet 135, 137 may be in positions other than those shown in FIGS. 6 and 11-14 provided that articles may be suitably loaded into chamber 101 and that article fragments 79 may exit chamber 101. One such alternative position of chamber inlet 135 is shown in article-destruction apparatus 10' of FIGS. 22 and 23. The generally cylindrically-shaped chamber 101 shown is merely exemplary as other chamber geometries will suffice. By way of example only, chamber 101, 101' may be of a spherical geometry with a lower portion of the sphere forming trough 123.

As shown in FIGS. 6 and 11-21B, head 145 in chamber 101, 101' is provided for striking articles (e.g., containers 11-15) and article fragments 79 within chamber 101, 101'. Head 145 includes a body portion 147 and a shaft 149 which is preferably coupled directly to motor drive shaft 185 through wall 121 as explained below. Body 147 and shaft 149 have a common axis of rotation 151 which is generally horizontal when head 145 is mounted in chamber 101, 101'. By generally horizontal, it is meant that axis 151 is in the range of approximately 45° to 135° to horizontal. In the examples, body 147 has an axial extent 153 along axis 151 between outer and inner body surfaces 155, 157. Body 147 preferably lies in a plane 159 parallel to or co-extensive with axis 133 for rotation when mounted in chamber 101, 101'.

In the embodiments of FIGS. 6 and 11-16, body 147 includes two striking elements 161*a*, 161*b*. Elements 161*a*, 161*b* extend radially outward from body 147 and axis 151 to a peripheral edge 163 thereby providing body 147 with a radial extent 165 between axis 151 and peripheral edge 163. Body 147 and elements 161*a*, 161*b* are carefully balanced to ensure that head 145 rotates smoothly when driven at high speed.

Each striking element 161*a*, 161*b* has a forward-facing radial striking surface 167. Each surface 167 is forward facing in the sense that it faces a direction of head 145 rotation indicated by arrow 169. As shown in the examples of FIGS. 17C, 18C, 19C, and 20C, each forward-facing radial striking surface 167 has an area with portions extending along both the axial 153 and radial 165 extents (i.e., a surface rather than an edge). By having an area, the striking surfaces 167 differ from knife-type cutters which require a leading edge in the nature of a knife. Each such surface 167 may be planar, concave, convex or any other suitable shape or combination of shapes (e.g., cupped and planar surfaces) having an area.

Shaft 149 is secured with respect to body 147 coaxial with body 147 and rotational axis 151. Preferably, body 147 and shaft 149 are a one-piece member, such as a one-piece metal casting or machined part. However, shaft 149 may be a separate part joined to body 147 by means of a suitable fastener (not shown). As noted previously, shaft 149 is preferably supported by motor drive shaft 185 along a generally horizontal rotational axis 151. This preferred arrangement locates plane 159 in which head 145 rotates in an approximately vertical position (i.e, approximately 45° to 315° to vertical). The preferred shaft 149 is positioned with respect to chamber 101, 101' such that, during head 145 rotation, the striking elements 161*a*, 161*b* pass within trough 123 closely proximate trough bottom 125 to strike articles (e.g., containers 11-15) and article fragments 79 in trough 123. After striking, the article fragments 79 fall back into trough 123 for repeated contact with head 145 striking elements 161*a*, 161*b*, 161*c* during movement past trough bottom 125. This process continues until the fragments 79 are of a sufficiently small size to exit chamber 101, 101' through outlet 137. Repeated striking is particularly useful for plastic articles and articles which may be of a more pliant material with a lower durometer and which are not as brittle as glass objects which typically require only a single contact to shatter into small pieces.

High-speed direct contact between striking element surfaces 167 and articles (e.g., containers 11-15) and article fragments 79 is a highly effective means of disintegrating, shattering and/or shearing such materials into particle-sized fragments of a reduced size. Because head 145 provides the article destruction, chamber 101 and walls 117-121 may be free of stationary knives utilized in other types of article-destruction apparatus.

Without wishing to be bound by any particular theory, it is believed that a further factor contributing to destruction of articles (e.g., containers 11-15) and article fragments 79 is the effect of low and high pressure regions created during rotation of exemplary heads 145 and 145*a* through 145*e* (FIGS. 17A-21B). As is shown schematically in FIGS. 21A and 21B, rotation of head 145 is believed to create a low pressure region 171 proximate head 145 and a high pressure region 173 outward from head 145. The area of the striking surfaces 167 pushes air in chamber 101, 101' and is thought to increase this effect. Low pressure region 171 induces movement of articles and article fragments 79 from trough 123 and chamber 101 toward head 145 while article fragments 79 are flung outward from head 145 by centrifugal force toward high pressure region 173 and into chamber 101, 101'.

Table 1 provides estimated air movement values expected to be produced by a rotating impeller having a diameter of 3.125 inches at standard temperature and pressure and at different rates of rotational displacement in units of RPMs. These data are based on calculations rather than actual measurements and are provided to illustrate that a small impeller is capable of displacing large air volumes, particularly in excess of 7900 RPMs. Air movement data are presented in units of cubic feet/minute (CFM).

TABLE 1

| RPM | CFM |
|---|---|
| 3000 | 921 |
| 5100 | 1556 |
| 7900 | 2426 |
| 9300 | 2856 |
| 10000 | 3071 |
| 12800 | 3931 |
| 14200 | 4361 |
| 15600 | 4791 |
| 17000 | 5221 |
| 18400 | 5651 |
| 19800 | 6081 |

Rotation of head 145 in chamber 101, 101' is believed to create a type of "cyclonic action" which circulates articles and article fragments 79 about trough 123 and chamber 101, 101' until fragments 79 are of a generally uniform desired reduced size sufficient to exit chamber 101, 101'.

A highly preferred form of head 145 is a "router bit" which includes a body portion 147 and shaft 149 in the form of an integral shank. A router bit is a type of head 145 that is used in conjunction with a router. The striking elements (e.g., elements 161*a*, 161*b*, 161*c*) of a router bit are compact with a limited radial extent 165 to provide maximum destructive leverage. Router bits are available from commercial sources such as the Vermont American® division of Robert Bosch Tool Corporation.

FIGS. 17A through 21B illustrate show head 145 alternative embodiments 145*a*, 145*b*, 145*c*, 145*d* and 145*e* suitable for use with article-destruction apparatus 10 and 10'. Each head embodiment 145*a*, 145*b*, 145*c*, 145*d* and 145*e* includes a body 147 and shaft 149, a rotational axis 151, an axial extent 153, and a radial extent 165 (FIG. 17C). Each head 145*a*, 145*b*, 145*c*, 145*d* and 145*e* includes two striking elements 161*a*, 161*b* or three striking elements 161*a*, 161*b*, 161*c*, each of which extends radially outward from body 147 and axis 151. Each striking element (i.e., 161*a*, 161*b*, 161*c*) includes a striking surface 167 having an area along at least portions of both the radial and axial extents. It is envisioned that knives and other elements may be carried on head 145 and used in combination with elements 161*a*, 161*b*, 161*c*.

Body 147 may include one or more edge 163 profiles. For example, head 145 of FIGS. 6 and 11-16 is provided with a "stepped profile" in which body 147 has segments which are stepped with respect to the other. Heads 145*a* (FIGS. 17A-17C) and 145*e* (FIGS. 21 A-21 B) have a "beveled profile" in which body 147 has an outwardly angled beveled surface. Head 145*b* (FIGS. 18A-18C) has a "scarfed profile" which is particularly useful for destruction of relatively pliant articles and bottles (e.g., containers 13, 15), head 145*c* (FIGS. 19A-19C) has a generally convex profile, and head 145*d* (FIGS. 20A-200) has a generally concave profile. Other types of profiles may have particular utility for a particular article-destruction application.

Figures 17A, 17B, 17C:
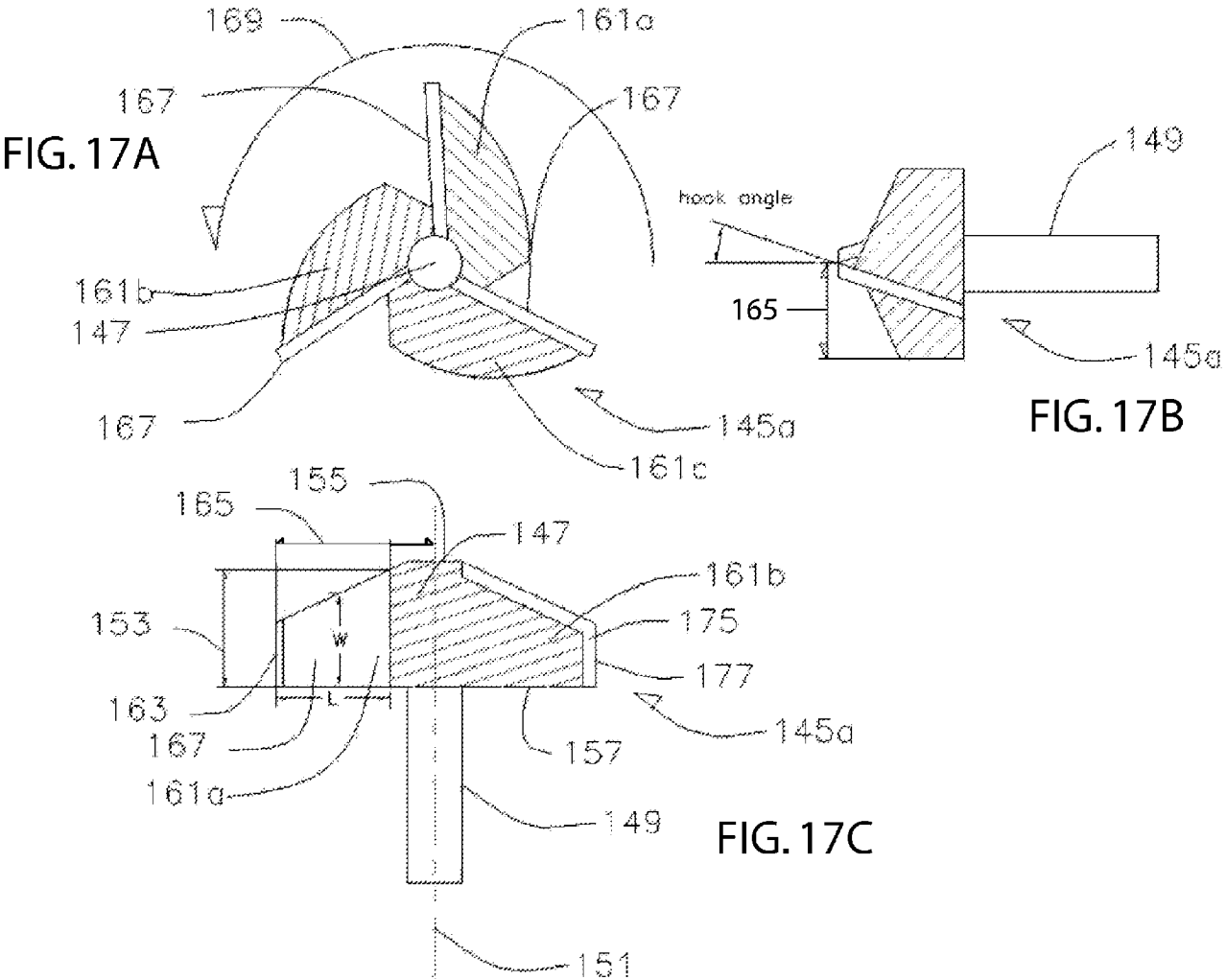
FIGS. 17A-17C show an exemplary head having three striking elements and a beveled edge profile.

Striking surface 167 may optionally include a tip 175, seen for example in FIG. 17C. Tip 175 may be soldered or otherwise attached to striking element 161*a*, 161*b* for added strength. Tip 175 may, for example, be a carbide tip. Such a tip 175 may protrude slightly outward beyond body 147 and may include a sharpened outer edge surface 177 also as seen in FIG. 17C.

Figures 19A, 19B, 19C:
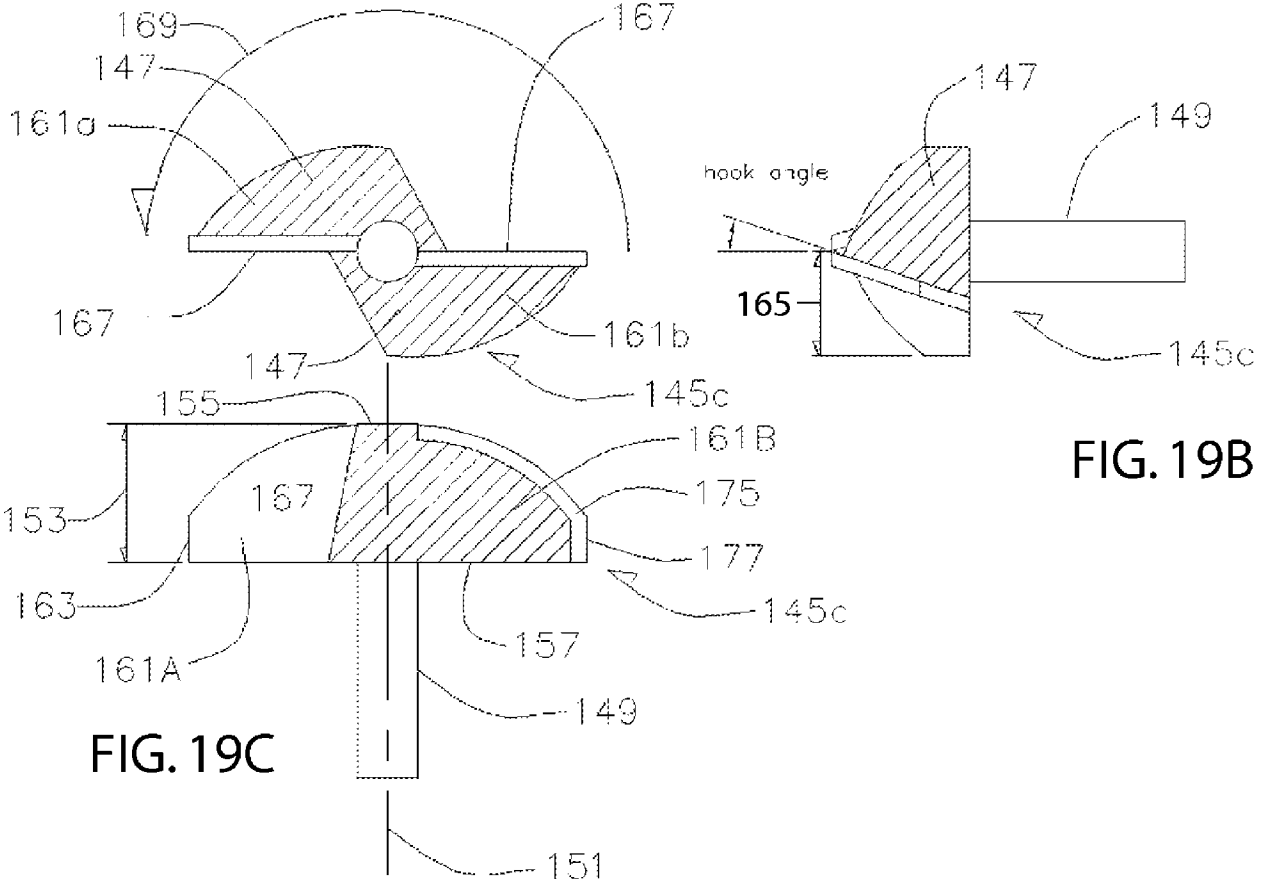
FIGS. 19A-19C show an exemplary head having two striking elements and a convex-type profile.
Figures 20A, 20B, 20C:
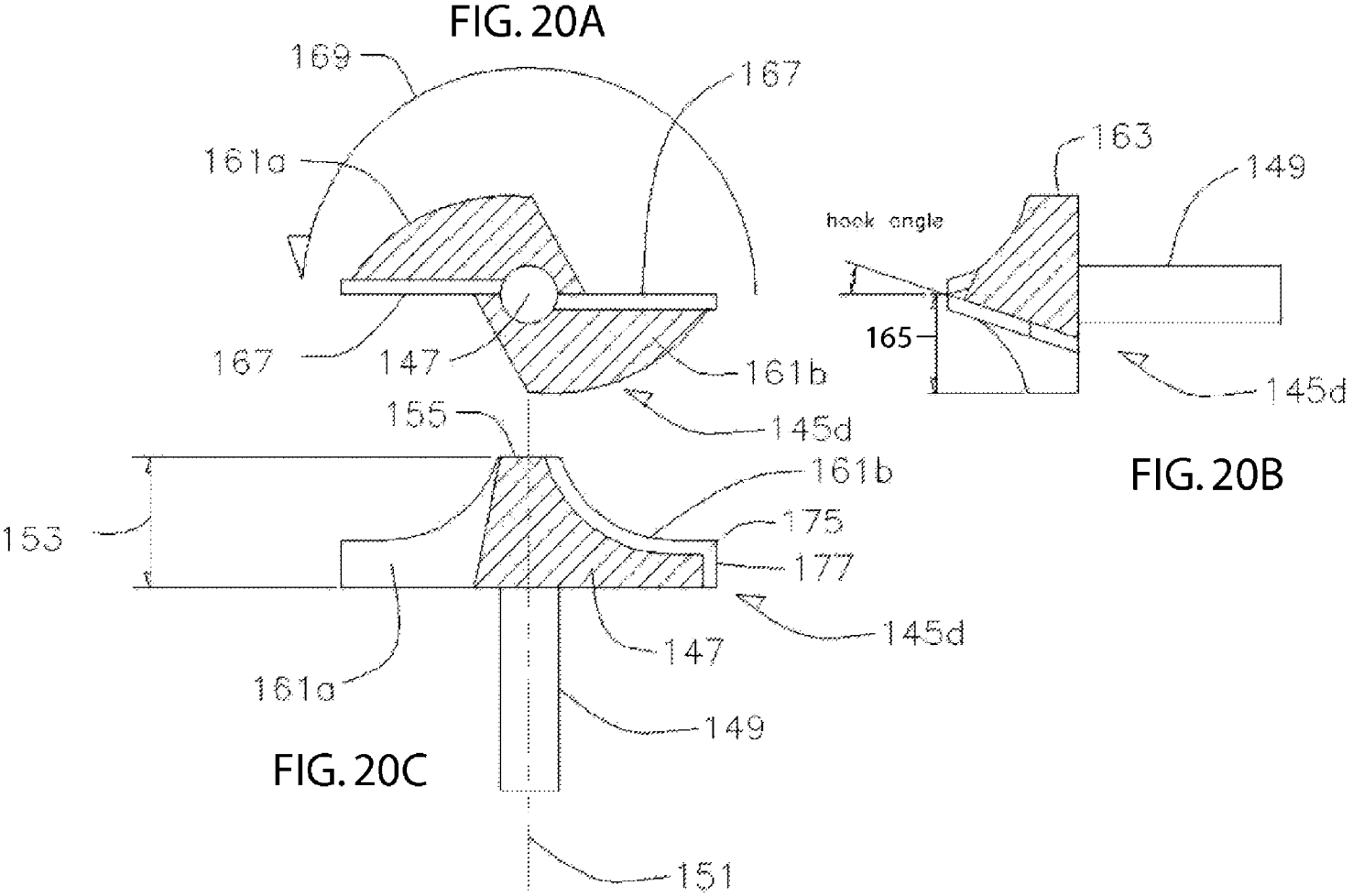
FIGS. 20A-20C show an exemplary head having two striking elements and a concave-type profile.
Figure 21A:
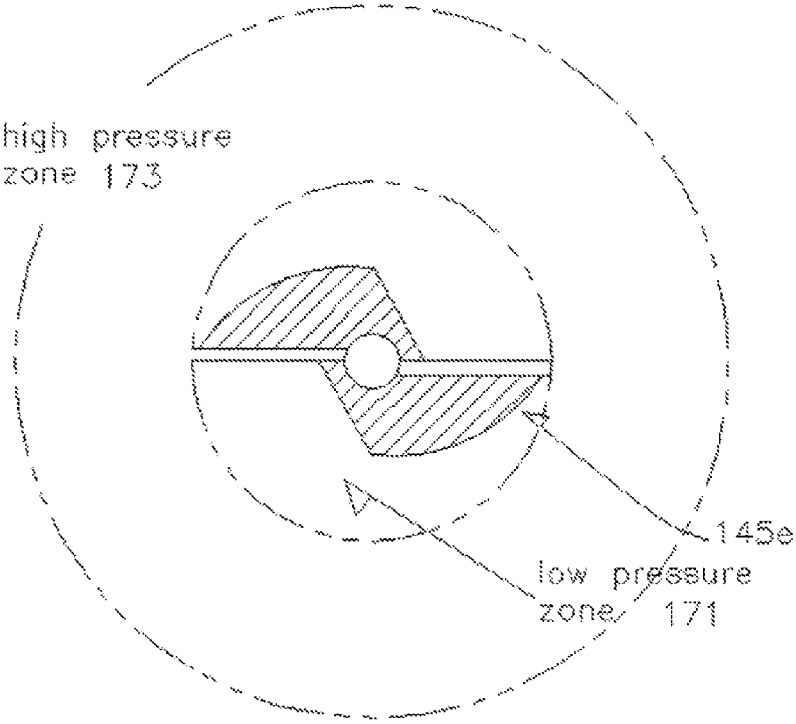
FIGS. 21A-21B show an exemplary head having two striking elements and a beveled profile generally indicating regions of high and low pressure created during head rotation.
Figure 21B:
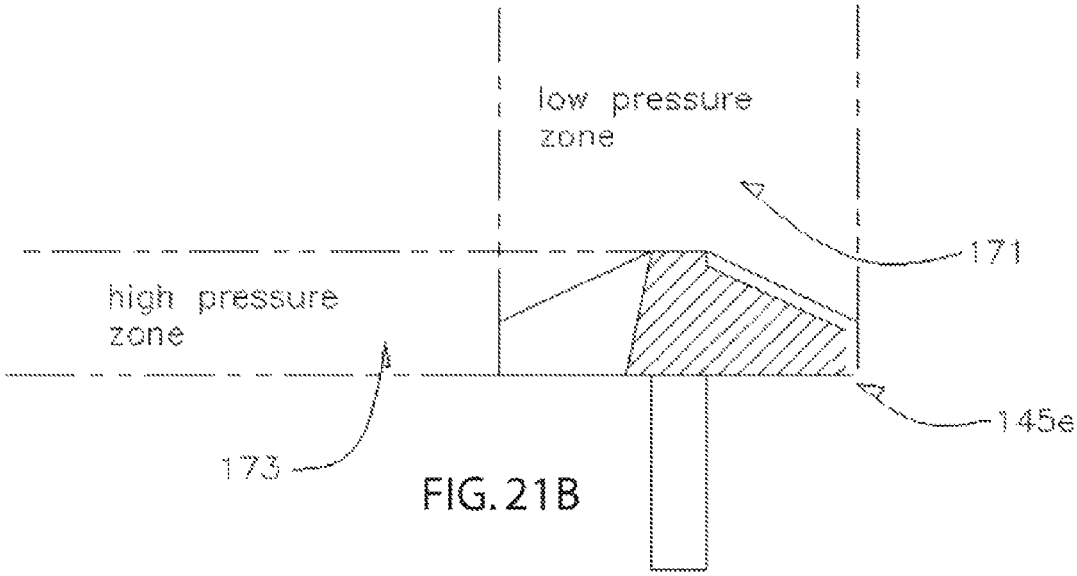

The efficiency of head 145 with respect to article destruction may optionally be improved by providing each forward-facing radial striking surface 167 with a "hook angle" and/or a "shear angle." Referring to FIGS. 17A and 19A, and 20A, striking surfaces 167 of heads 145*a*, 145*c*, and 145*d* include a hook angle in which surfaces 167 are oriented at an angle relative to rotational axis 151. Providing a hook angle, or pitch, to striking surfaces 167 is useful to create low pressure region 171 drawing articles and article fragments from trough 123 and chamber 101, 101' toward outer head outer surface 155 and into contact with striking surfaces 167.

Figures 18A, 18B, 18C:
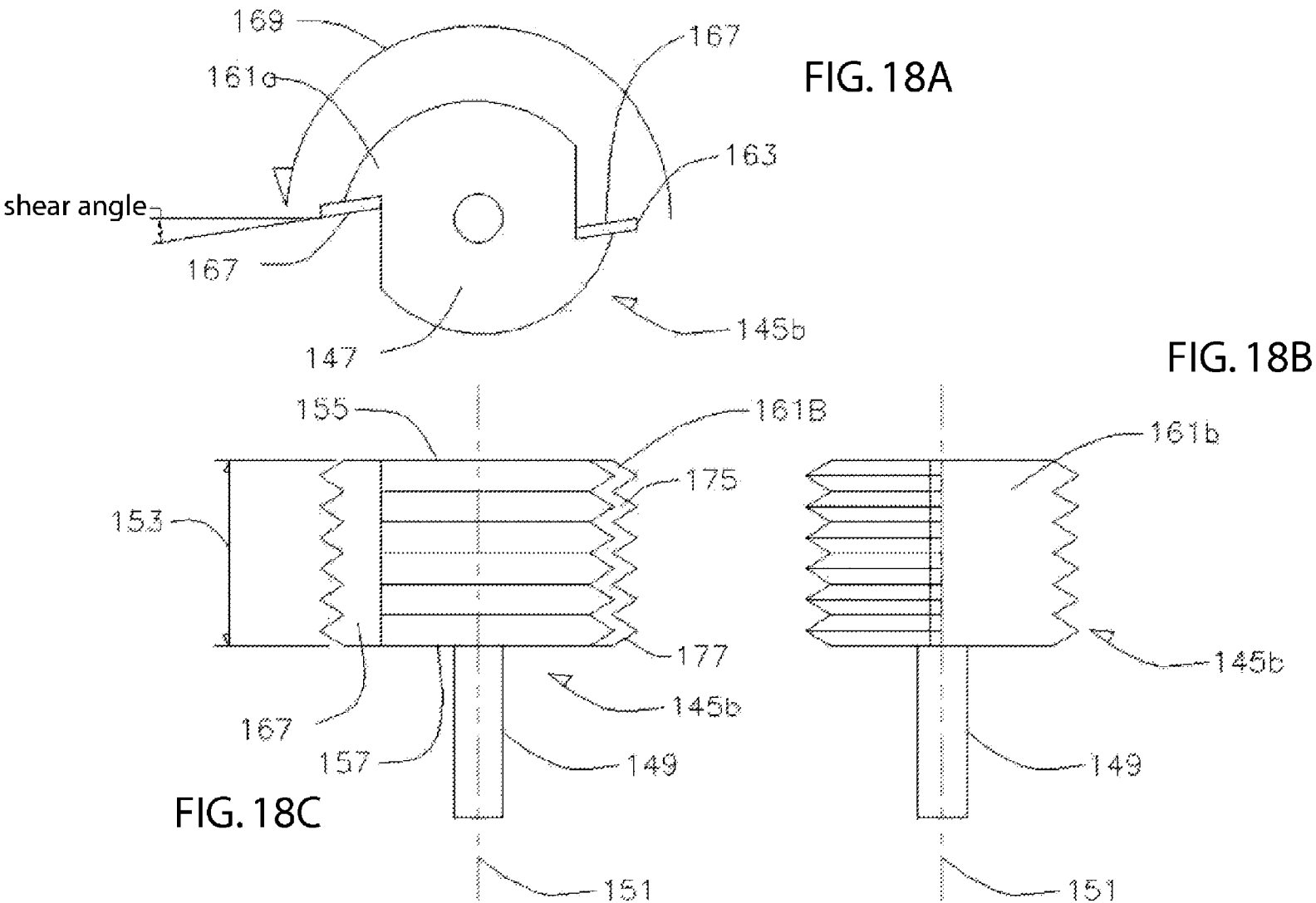
FIGS. 18A-18C show an exemplary head having two striking elements and a scarfed edge profile.

Referring to FIGS. 17A and 18A, striking surfaces 167 of heads 145*a* and 145*b* include a shear angle in which surfaces 167 are oriented at a forward facing angle relative to the radii defining the radial extent 165. If provided, the shear angle of surfaces 167 is useful to position sharpened edge 177 and surfaces 167 to more aggressively contact and destroy articles and article fragments during head rotation.

FIGS. 6 and 11-14 show an example of a highly preferred position of head 145 with respect to chamber 101 and trough 123. In the embodiment, shaft 149 is journaled in end wall 121 in a preferred generally horizontal orientation thereby positioning head 145 body 147 for rotation in plane 159 (FIG. 14) which is preferably about normal (i.e., generally perpendicular) to chamber central axis 131. As previously noted, shaft 149 and rotational axis 151 need not be fully horizontal as head 145 is effective in non-horizontal orientations provided that peripheral edge can pass proximate to trough bottom 125 to contact article fragments 79 in trough 123 during head rotation.

In the preferred embodiment shown in FIGS. 6 and 11-14, plane 159 in which head 145 rotates is offset inwardly from chamber lateral axis 133 and head rotational axis 151 is offset from and below chamber central axis 131 as best seen in FIGS. 12-13. This preferred arrangement is useful to position the lowermost portion of striking element peripheral edges 163 in trough 123 closely proximate trough bottom 125 so that striking elements 161*a*, 161*b* will contact articles (e.g., containers 11-15) and article fragments 79 in trough 123. By offsetting head 145 inward of lateral axis 133 a greater portion of trough 123 is provided to collect article fragments 79 which are then drawn toward low pressure region 171 and into contact with rotating head 145 striking elements 161*a*, 161*b*.

Chamber embodiment 101' of FIGS. 15-16 is identical to that of FIGS. 6 and 11-14 except that the spacing of peripheral edge 163 from trough bottom 125 during head 145 rotation is relatively greater. To be effective at article destruction, spacing between head 145 peripheral edge 163 and trough bottom 125 must be such that articles and article fragments 79 in trough 123 can be repeatedly contacted by striking surfaces 167 until reduced to the desired small size. In the examples, a range of spacing between lowermost portion of peripheral edge 163 during head 145 rotation and trough bottom 125 is preferably about 0.020 to about 1.625 inches. Increases in such spacing can be compensated for by reliance on head 145 structure which increases low pressure in region 171 inducing movement of articles and article fragments 79 into contact with rotating head 145.

Referring again to FIGS. 6-16, rotation of head 145 is provided by a high-speed drive apparatus 179 in power-transmission relationship with head 145. High speed refers to rotation of head 145 at rates exceeding 7,000 revolutions per minute (RPMs) and, more preferably, in the range of about 10,000 to about 25,000 RPMs. In the examples, drive apparatus 179 includes a direct-drive motor 181 which powers rotation of head 145. Motor 181 is preferably a 120V AC motor of about 1 to 5 horsepower. Motor 181 may be reversible in order to clear any jam condition which may exist. Motor 181 is supported by motor mount 187. As shown in FIG. 14B, head 145 may be linked to motor drive shaft 185 by seating of shaft 149 in a compression fitting 225 within shaft 185. Collar nut 223 is tightened onto external threads on drive shaft 181 to form a compression fit between shafts 149, 185. This arrangement permits a user to easily switch between different heads, for example to remove a head 145 for replacement, repair or to utilize a head that could be more effective for destruction of a particular article type.

Figure 24:
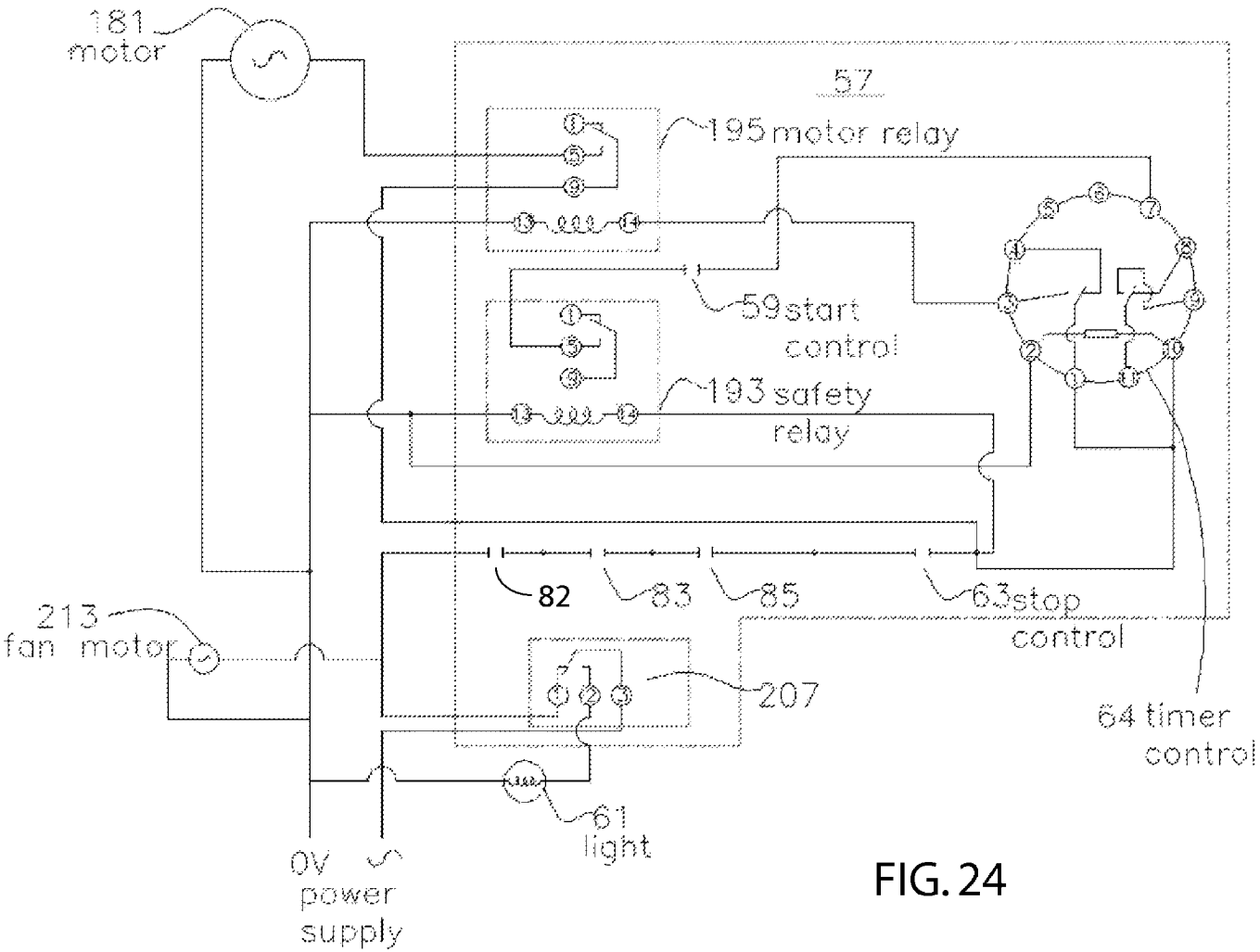
FIG. 24 is a schematic circuit diagram of an exemplary control circuit suitable for use with the article-destruction apparatus of FIGS. 5-15 and 22-23.

FIGS. 23-24 show a further article-destruction apparatus 10' embodiment illustrating that the apparatus may be scaled to meet user requirements. Apparatus 10' is a more compact form of apparatus 10 which can fit beneath a work surface, such as a bench top 55. Apparatus 10' is particularly useful in applications requiring an article throughput less than that of apparatus 10.

Apparatus 10' includes a housing 37, sides 39-49, legs (e.g., leg 51), access panel 73 with latch 75, and chamber 77 for storing fragment-receiving receptacle 81. Push-button-type start and stop controls 59, 63 permit user interface with control apparatus 57 to control operation of motor 181 and article-destruction apparatus 10' as described with respect to apparatus 10. Indicator lamp 61 is provided to indicate that receptacle 81 is full as described below in connection with apparatus 10. A detector 80 for detecting an element 84 associated with receptacle 81 may also be provided as described in connection with apparatus 10. Control 64 (FIG. 24) of control apparatus 57 permits user adjustment of a time period of motor 181 operation also as described in connection with apparatus 10.

Article-destruction chamber 101 includes inner and outer walls 117, 119, 121, trough 123 and trough bottom 125 as described with respect to article-destruction apparatus 10. Motor-driven 181 rotating head 145 rotates within chamber 101 closely proximate to trough bottom 125 to strike and destroy articles and article fragments also as described in connection with apparatus 10. Bag-type receptacle 81 secured to flange 143 receives article fragments 79 from chamber outlet 137 and nozzle 141.

Articles, such as containers 11-15, are delivered to article-destruction chamber 101 through chute 217. Chute 217 has an inlet 219 and an outlet 221 through which articles enter chamber 101 through chamber inlet 135. Chamber inlet 135 is in wall 119. Chute may be sized to receive any size article or container. Articles loaded one after the other into chute 217 fall by means of gravity into chamber 101 for destruction in the manner described with respect to apparatus 10.

FIG. 24 is a schematic circuit diagram illustrating an exemplary control apparatus 57 provided to control operation of article-destruction apparatus 10 or 10'. Control apparatus 57 may comprise a series of relays, controls and switches as shown in the schematic of FIG. 24 or may comprise any other suitable control or controls. By way of example only, control apparatus 57 may be a programmable logic controller ("PLC") which operates according to a "ladder logic" protocol known to those of skill in the art or a personal computer-based or micro controller-based control system in which firmware or software-based instructions control apparatus 10, 10' operation.

As shown in FIGS. 5 and 22, controls 59, 63 and lamp 61 are operably connected to control apparatus 57. Conductors 189, 191(FIG. 9) are representative stylized conductors provided for this purpose. Control apparatus 57 is operably connected to motor 181, also through suitable conductors. Operation of push-button-type start control 59 closes safety relay 193 and motor relay 195 activating motor 181. Safety relay 193 deactivates motor 181 independently in the even of a short circuit, electrical malfunction or motor over current condition. Motor-timer control 64 may be a rotary potentiometer within control apparatus 57, adjustment of which causes control apparatus 57 to activate motor 181 for a desired time increment. Pushing of stop control 63 opens the circuit and causes safety relay 193 to deactivate motor 181. As discussed previously, interlock devices 83, 85 cause safety relay 193 to open deactivating apparatus 10 when door 65 or panel 73 is/are open.

Control apparatus 57 may include a control provided to deactivate article-destruction apparatus 10 once article fragments 79 in receptacle 81 exceed a limit. In article-destruction apparatus embodiment 10, 10', receptacle 81 rests on platform 197 which is attached to housing side 39 at one end by hinges 199, 201 and is supported at an opposite end by springs 203, 205. Springs 203, 205 are selected to provide a spring force capable of supporting a desired mass of article fragments 79. For example, springs 203, 205 may be selected such that the spring force is overcome when the mass of article fragments 79 reaches a threshold value of 10 pounds. As the mass of article fragments 79 in receptacle increases and exceeds the threshold value and the spring force provided by springs 203, 205, platform 197 moves downward and into contact with contact switch 207. Once contacted by platform 197, switch 207 provides a signal which opens safety relay 193 deactivating drive apparatus 179. Switch 207 may also trigger operation of an indicator lamp 61 provided to notify a user that receptacle 81 is full of article fragments and must be replaced. Apparatus 10 remains in a deactivated state pending removal of receptacle 81.

Referring to FIGS. 8-10 and 22-23, article-destruction apparatus 10, 10' may include an air filtration system to remove small air-borne article fragments 79 from housing 37. As can be appreciated, destruction of articles (e.g., containers 11-15) generates small particles which may be suspended in air within housing 37. Removal of such particles is desirable to prevent the particles from covering the interior surfaces of apparatus 10, 10'. Fan-type blower 211 is provided in a housing side (e.g., side 41). Fan 211 as shown, is a motor-driven 213 fan assembly which discharges air from housing 37. Particulates are drawn toward fan 211 and are trapped in filter media 215. Media 215 may comprise a hepafilter to facilitate removal of particles on the order of 0.3 microns.

Article-destruction apparatus 10 shown and described herein is a floor-standing embodiment intended for use by a pharmacies, healthcare providers, vendors, or others with a high volume of articles requiring destruction. Quantities of articles can be loaded into hopper 71 for high-throughput destruction. An advantage of article-destruction apparatus 10 is that the apparatus may be scaled up for users which have a correspondingly greater waste volume or may be scaled down for use by a pharmacy or healthcare provider with a lesser amount of waste but yet still having an important need to ensure that confidential patient information is disposed of properly and in compliance with all applicable privacy-related regulations.

Operation of article-destruction apparatus 10, 10' and methods of destroying articles (e.g., containers 11-15) and any associated information 23, 33, 35 by means of apparatus 10, 10' will now be described. The specific steps performed will depend on the configuration and features of the specific article-destruction apparatus 10, 10' embodiment utilized. Considerable variation is possible consistent with the principles of apparatus 10, 10' operation.

In operation, a user first checks indicator lamp 61 to confirm that receptacle 81 is not yet full and can accept additional article fragments 79. If a detector 80 is provided, deactivation of lamp 61 also indicates that a receptacle 81 from an authorized source is in place. If the indicator lamp 61 is off, the user grasps handle 67 and opens door 65 in apparatus 10 top side 47. One or more articles (e.g., containers 11-15) are then loaded by the user into hopper 71 through door 65. Interlock 83 deactivates article-destruction apparatus 10 while door 65 is open. Door 65 is closed once loading of the articles is complete. For embodiment 10', articles are loaded into chute 217 inlet 219. A wide range of containers and articles may be destroyed with apparatus 10, 10' including containers and articles made of a range of different material types.

Articles in hopper 71 move downward toward hopper outlet 97 under the influence of gravity. If provided, agitator 107 dislodges any jammed articles facilitating free movement of the articles within hopper 71. The articles are then delivered through hopper outlet 97 and to article-destruction chamber 101 through chamber inlet 135. The articles fall into trough 123 of chamber 101. Articles in chute 217 exit chute outlet 221 and enter chamber 101 through chamber inlet 135.

The user activates apparatus 10 by closing push-button-type control 59. The motor 181 run time is determined by setting of control 64. Pushing of start control 59 causes control apparatus 57 to activate motor 181 of drive apparatus 179. Activation of motor 181 causes head 145 in chamber 101 to rotate at a high speed, preferably over 7,000 RPM, and more preferably between 10,000 and 25,000 RPMs.

During high-speed rotation of head 145, striking element 161*a*, 161*b* surfaces 167 pass closely proximate trough 123 and trough bottom 125 to strike articles and article fragments 79 in trough 123. Striking of the articles with at least one of the striking surfaces 167 during head 145 rotation imparts a massive force to the article, instantaneously separating the article into article fragments 79. The article fragments 79 are flung away from head 145. Chamber walls 117-121 direct fragments back into trough 123 under influence of gravity.

Article fragments 79 are circulated within chamber 101 by repeated contact with striking elements 161*a*, 161*b* of rotating head 145 and by walls 117-121. Repeated striking of article fragments 79 in trough 123 during head 145 rotation reduces the size of such article fragments 79 and renders unusable any information 23 in any form (e.g., on a label 31 or RFID tag 35) which may have been associated with the article. Facilitating circulation of article fragments 79 within chamber 101, are the low and high pressure regions 171, 173 about head 145 which induce displacement and movement of fragments toward and away from head 145. This effect can be amplified by providing striking elements (e.g., elements 161*a*, 161*b*, 161*c*) with a shear angle. The powerful destructive forces applied by the head 145 destroy articles and containers (e.g., containers 11-15) with a wide range of material properties, including pliant and more rigid properties.

Once the fragments 79 are of a desired reduced size, they exit chamber 101 through chamber outlet 137. Openings 139 in wall 117 (or openings in a barrier over outlet 137) are sized to permit article fragments 79 smaller than the openings to pass therethrough once the fragments 79 are smaller than the openings. Article fragments 79 are channeled from outlet 137 through nozzle 141 and into fall into receptacle 81.

After many articles have been destroyed, receptacle 81 is filled with article fragments 79 and switch 207 is triggered to deactivate drive apparatus 179 through control apparatus 57. Indicator lamp 61 will be activated by control apparatus 57 to notify the user that receptacle 81 must be emptied or replaced. To accomplish this, the user will grasp latch 75, open access panel 73 and remove receptacle 81. Opening of panel 73 deactivates motor 181 through interlock 85.

Article fragments 79 in receptacle 81 may be dumped in a waste receptacle (not shown) of the pharmacy, healthcare provider, vendor, or other user or the receptacle 81 may be placed directly in the waste receptacle. Any information 23 on, or associated with, the articles is rendered completely unusable and may be disposed of safely in full compliance with HIPPA and other privacy-related regulations. And, the volume of waste will have been reduced significantly, dramatically reducing the overall volume of waste generated by the user. Reduction of waste volume is beneficial because it reduces the cost of waste removal and is environmentally friendly by reducing the volume of land fill space required for waste disposal. Reduction of containers (e.g., containers 11-15) to article fragments 79 and use of separate receptacles 81 for each fragment 79 material type may facilitate container recycling by reducing the cost to store, transport and process the waste containers into new and useful articles.

While the principles of this invention have been described in connection with specific embodiments, it should be understood clearly that these descriptions are made only by way of example and are not intended to limit the scope of the invention.

What is claimed is:

1. Apparatus for destruction of articles and any information associated therewith, the apparatus comprising:

an article-destruction chamber having an article inlet, at least one wall forming a trough including a trough bottom, and an article-fragment outlet, said chamber being free of a stationary knife;

an independent router bit head for striking articles and article fragments in the chamber, the head including:

a body portion having a rotational axis, a radial extent about the axis and an axial extent, the body further having plural rigid striking elements extending radially outward therefrom, each striking element having a peripheral edge and a forward-facing radial striking surface with an area extending along at least a portion of both the radial and axial extents; and a shaft secured with respect to the body portion coaxial with the rotational axis, the shaft being positioned with respect to the chamber such that, during head rotation, the striking elements pass within the trough closely proximate the trough bottom to strike articles and article fragments therein;

a drive apparatus in power-transmission relationship with the shaft to power rotation of the head; and control apparatus operatively controlling the drive apparatus.

2. The apparatus of claim 1 wherein the chamber comprises:

a generally annular inner wall; and a pair of opposed end walls, the inner and outer walls defining the trough in a lower portion of the chamber.

3. The apparatus of claim 1 wherein the chamber includes a chamber central axis bisecting the chamber between the side walls and the head rotates in a plane which is about normal to the chamber central axis.

4. The apparatus of claim 3 wherein the chamber further includes a chamber lateral axis bisecting the chamber, and the plane in which the head rotates is offset from the chamber lateral axis and the axis of head rotation is offset from and below the chamber central axis.

5. The apparatus of claim 1 wherein the shaft is integral with the body.

6. The apparatus of claim I wherein each forward-facing radial striking surface is planar.

7. The apparatus of claim 6 wherein each forward-facing radial striking surface includes one or more of a hook angle and a shear angle.

8. The apparatus of claim 1 wherein the body has a profile comprising one or more of a stepped profile, a beveled profile, a concave profile, a convex profile and a scarfed profile.

9. The apparatus of claim 1 further comprising:

a housing;

at least one wall within the housing defining a path directing articles to the chamber; and a receptacle in the housing for receiving article fragments from the chamber.

10. The apparatus of claim 9 wherein the at least one wall comprises a hopper and the apparatus further comprises an agitator associated with the hopper.

11. The apparatus of claim 9 further comprising a control operative to deactivate the drive apparatus when article fragments in the receptacle reach a threshold value.

12. The apparatus of claim 11 further comprising a control operative to generate a signal if a receptacle is not present in the apparatus.

13. The apparatus of claim 11 further comprising a control operative to generate a signal if the receptacle is from an unauthorized source.

14. The apparatus of claim 9 wherein the drive apparatus includes a motor and the motor powers head rotation through the shaft at a rate in excess of approximately 7,000 revolutions per minute.

15. The apparatus of claim 14 wherein the motor powers head rotation at a rate of approximately 10,000 revolutions per minute to about 25,000 revolutions per minute.

16. The apparatus of claim 1 wherein the control apparatus includes a time-based control operable to power the drive apparatus for a selected time.

17. The apparatus of claim 9 further comprising:

a blower in the housing adapted to discharge air out of the housing; and a filter mounted with respect to blower and positioned to remove particulates from the air.

18. Apparatus for destruction of articles and any information associated therewith, the apparatus comprising:

an article-destruction chamber having an article inlet, a trough, and an article-fragment outlet, said chamber being free of a stationary knife;

an independent router bit head having a coaxial body and shank and rigid radially-outward-extending striking elements, each striking element having a forward-facing radial striking surface with an area, the head being rotatable in the chamber about a generally horizontal axis such that, during rotation, the striking elements pass within the trough to repeatedly strike articles and article fragments therein;

a high-speed drive apparatus in power-transmission relationship with the shank; and control apparatus operatively controlling the drive apparatus.

19. The apparatus of claim 18 wherein the drive apparatus includes a motor and the motor powers head rotation through the shaft at a rate of approximately 7,000 to 25,000 revolutions per minute.

20. The apparatus of claim 18 further comprising:

a housing;

at least one wall within the housing defining a path directing articles to the chamber; and a receptacle in the housing for receiving article fragments from the chamber.

21. A method of destroying articles and any information associated therewith, the method comprising:

delivering an article to an article-destruction chamber having an independent router bit striking head therein and at least one wall forming a trough free of a stationary knife, the head having a coaxial body and shank and radially-outward-extending rigid striking elements, each striking element having a forward-facing radial striking surface with an area, the head being rotatable in the chamber such that, during rotation, the striking elements pass within the trough;

rotating the head at a high speed by rotation of the shaft with a drive apparatus;

striking the article with at least one striking surface during head rotation, thereby separating the article into article fragments which fall into the trough; and repeatedly striking the article fragments in the trough and chamber during head rotation with at least one striking surface until the fragments are of a reduced size and any information associated with the article is rendered unusable.

22. The method of claim 21 further comprising circulating the article fragments within the chamber for repeated striking.

23. The method of claim 22 wherein circulating comprises displacing the article fragments into contact with the head during head rotation by creating a low pressure region around the head and a high pressure region outward from the head.

24. The method of claim 21 wherein delivering an article to the chamber further comprises loading the article in a hopper, the hopper directing the article to the chamber.

25. The method of claim 24 further comprising agitating a plurality of articles in the hopper to provide free-flow of the articles to the chamber.

26. The method of claim 21 further comprising discharging the article fragments from the chamber through plural openings sized to permit article fragments smaller than the openings to pass therethrough.

27. The method of claim 26 further comprising collecting the article-fragments in a receptacle after discharge from the chamber

28. The method of claim 27 further comprising stopping head rotation once article fragments in the receptacle exceed a threshold.

29. The method of claim 26 further comprising, before discharging, detecting that a receptacle is present to receive the article fragments.

30. The method of claim 21 wherein rotating the head at high speed comprises rotating the head at a rate in excess of approximately 7,000 revolutions per minute.

31. The method of claim 30 wherein rotating the head at high speed comprises rotating the head at a rate of about 10,000 revolutions per minute to about 25,000 revolutions per minute.

* * * * *